US010795295B2

(12) United States Patent
Inoue et al.

(10) Patent No.: US 10,795,295 B2
(45) Date of Patent: Oct. 6, 2020

(54) HEATER, FIXING DEVICE, AND IMAGE FORMING APPARATUS

(71) Applicants: Daisuke Inoue, Tokyo (JP); Tomoya Adachi, Kanagawa (JP); Yuusuke Furuichi, Kanagawa (JP); Yukimichi Someya, Saitama (JP)

(72) Inventors: Daisuke Inoue, Tokyo (JP); Tomoya Adachi, Kanagawa (JP); Yuusuke Furuichi, Kanagawa (JP); Yukimichi Someya, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/701,686

(22) Filed: Dec. 3, 2019

(65) Prior Publication Data

US 2020/0249601 A1 Aug. 6, 2020

(30) Foreign Application Priority Data

Jan. 31, 2019 (JP) ..... 2019-016136

(51) Int. Cl.
*G03G 15/20* (2006.01)
*H05B 3/03* (2006.01)
(Continued)

(52) U.S. Cl.
CPC ..... *G03G 15/2053* (2013.01); *G03G 15/2064* (2013.01); *G03G 15/80* (2013.01);
(Continued)

(58) Field of Classification Search
CPC . G03G 15/2053; G03G 15/2064; G03G 15/80
See application file for complete search history.

(56) References Cited

U.S. PATENT DOCUMENTS 5,267,005 A * 11/1993 Yamamoto ..... H05B 3/265 338/306
5,874,710 A * 2/1999 Yoshimoto ..... G03G 15/2064 219/121.68

(Continued)

FOREIGN PATENT DOCUMENTS

| | | |
|---|---|---|
| JP | 2006-215056 | 8/2006 |
| JP | 2009-259714 | 11/2009 |
| JP | 2018-101036 | 6/2018 |

OTHER PUBLICATIONS

U.S. Appl. No. 16/391,959, filed Apr. 23, 2019 Takamasa Hase, et al.

(Continued)

*Primary Examiner* — Gregory H Curran
(74) *Attorney, Agent, or Firm* — Harness, Dickey & Pierce, P.L.C.

(57) ABSTRACT

A heater includes a base and at least one resistive heat generator mounted on a face of the base. At least one electrode supplies power to the at least one resistive heat generator. A conductor couples the at least one electrode with the at least one resistive heat generator. A slide layer covers the at least one resistive heat generator and the conductor. The slide layer includes a projecting portion that defines a surface of the slide layer. The projecting portion is defined by a film thickness of at least one of the conductor and the at least one resistive heat generator. The projecting portion includes an upstream projection disposed opposite a lateral end of the base in a longitudinal direction of the base and a downstream projection disposed downstream from the upstream projection in a rotation direction of an endless belt that slides over the heater.

15 Claims, 10 Drawing Sheets

(51) Int. Cl.
*G03G 15/00* (2006.01)
*H05B 3/00* (2006.01)

(52) U.S. Cl.
CPC ..... *H05B 3/0019* (2013.01); *H05B 3/03* (2013.01); *G03G 2215/2032* (2013.01); *G03G 2215/2048* (2013.01); *H05B 2203/013* (2013.01)

(56) References Cited

U.S. PATENT DOCUMENTS 8,818,222 B2 * 8/2014 Tamaki ..... G03G 15/2053 399/329
2017/0248879 A1 8/2017 Ishigaya et al.
2017/0248885 A1 8/2017 Saitoh et al.
2017/0255149 A1 9/2017 Takagi et al.
2017/0343942 A1 11/2017 Okamoto et al.
2018/0011434 A1 1/2018 Adachi
2018/0088502 A1 3/2018 Sugiyama et al.
2018/0203384 A1 7/2018 Okamoto et al.
2018/0329342 A1 11/2018 Seshita et al.
2018/0356755 A1 12/2018 Hiroi et al.
2019/0094764 A1 3/2019 Ishigaya et al.
2019/0179242 A1 6/2019 Adachi et al.
2019/0196374 A1 6/2019 Adachi et al.
2019/0243291 A1 8/2019 Matsuda et al.
2019/0278206 A1 9/2019 Adachi et al.
2019/0286026 A1 9/2019 Furuichi et al.
2019/0286028 A1 9/2019 Furuichi et al.
2019/0286029 A1 9/2019 Adachi et al.

OTHER PUBLICATIONS

U.S. Appl. No. 16/398,896, filed Apr. 30, 2019 Yutaka Naitoh, et al.
U.S. Appl. No. 16/451,512, filed Jun. 25, 2019 Tomoya Adachi, et al.
U.S. Appl. No. 16/502,348, filed Jul. 3, 2019 Yuusuke Furuichi, et al.
U.S. Appl. No. 16/502,473, filed Jul. 3, 2019 Yuusuke Furuichi, et al.

* cited by examiner

HEATER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-016136, filed on Jan. 31, 2019, in the Japan Patent Office, the entire disclosure of which is hereby incorporated by reference herein.

BACKGROUND

Technical Field

Exemplary aspects of the present disclosure relate to a heater, a fixing device, and an image forming apparatus, and more particularly, to a heater incorporating a resistive heat generator, a fixing device incorporating the heater, and an image forming apparatus incorporating the heater.

Discussion of the Background Art Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ fixing devices of various types to fix the image on the recording medium. As one example, the fixing device includes a fixing belt that is thin and has a decreased thermal capacity and a heater that heats an inner circumferential surface of the fixing belt. The heater includes a base and a resistive heat generator. The resistive heat generator of the heater is disposed on the base that extends in a width direction of the fixing belt.

In order to decrease a frictional resistance between the heater and the fixing belt that slides over the heater, a lubricant such as heat resistant grease is interposed between the heater and the fixing belt. When the fixing device is driven initially, a substantial amount of the lubricant is applied between the heater and the fixing belt. However, as the number of recording media that are conveyed through the fixing device increases, a part of the lubricant may leak from the fixing belt in the width direction thereof. As the fixing device suffers from shortage of the lubricant over time, the frictional resistance between the heater and the fixing belt that slides over the heater may increase, increasing a driving torque between the fixing belt and a pressure roller that drives the fixing belt.

On the other hand, the lubricant has a property that a viscosity of the lubricant increases at low temperatures and decreases as the temperature increases. Hence, if the lubricant in a substantial amount is applied between the heater and the fixing belt to address decrease of the lubricant over time, when the fixing device is driven initially, the lubricant that has an increased viscosity may increase a rotation torque of the pressure roller.

SUMMARY

This specification describes below an improved heater over which an endless belt rotatable in a rotation direction is slidable. In one embodiment, the heater includes a base that is elongate and platy and at least one resistive heat generator mounted on a face of the base. At least one electrode supplies power to the at least one resistive heat generator. A conductor couples the at least one electrode with the at least one resistive heat generator. A slide layer covers the at least one resistive heat generator and the conductor. The slide layer includes a projecting portion that defines a surface of the slide layer. The projecting portion is defined by a film thickness of at least one of the conductor and the at least one resistive heat generator. The projecting portion includes an upstream projection disposed opposite a lateral end of the base in a longitudinal direction of the base and a downstream projection disposed downstream from the upstream projection in the rotation direction of the endless belt.

This specification further describes an improved fixing device. In one embodiment, the fixing device includes a fixing rotator that is endless and rotates in a rotation direction and a heater over which an inner circumferential surface of the fixing rotator slides. A pressure rotator is disposed opposite the heater via the fixing rotator. The pressure rotator forms a fixing nip between the pressure rotator and the fixing rotator, through which a recording medium bearing an image formed with a developer is conveyed. The heater includes a base that is elongate and platy and at least one resistive heat generator mounted on a face of the base. At least one electrode supplies power to the at least one resistive heat generator. A conductor couples the at least one electrode with the at least one resistive heat generator. A slide layer covers the at least one resistive heat generator and the conductor. The slide layer includes a projecting portion that defines a surface of the slide layer. The projecting portion is defined by a film thickness of at least one of the conductor and the at least one resistive heat generator. The projecting portion includes an upstream projection disposed opposite a lateral end of the base in a longitudinal direction of the base and a downstream projection disposed downstream from the upstream projection in the rotation direction of the fixing rotator.

This specification further describes an improved image forming apparatus. In one embodiment, the image forming apparatus includes a developing device that forms an image with a developer and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 2A is a cross-sectional view of a fixing device according to a first embodiment of the present disclosure, which is incorporated in the image forming apparatus depicted in

FIG. 1A;

Figure 1A:
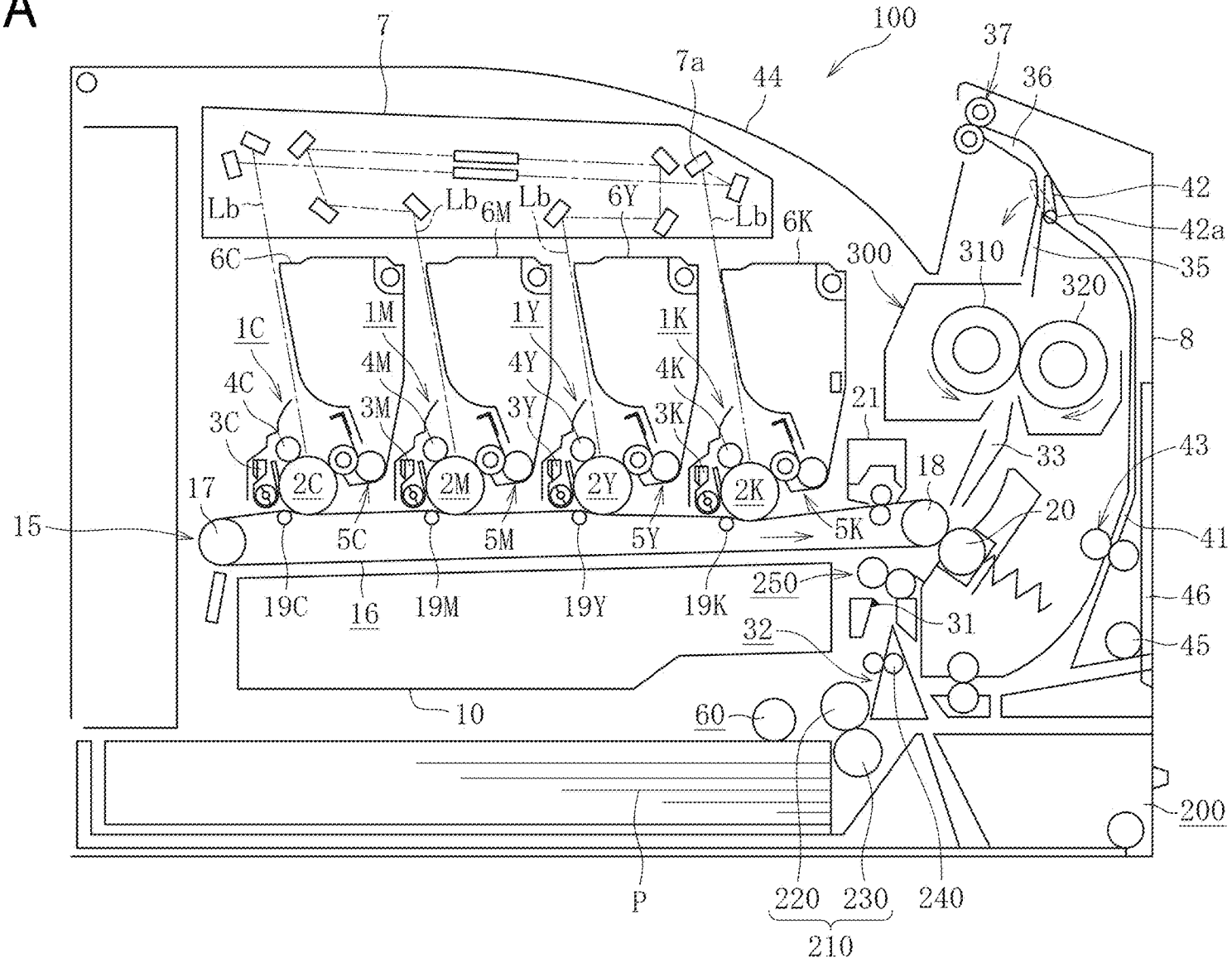
FIG. 1A is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a heater, a fixing device incorporating the heater, and an image forming apparatus (e.g., a laser printer) incorporating the fixing device according to embodiments of the present disclosure.

A laser printer is one example of the image forming apparatus. The image forming apparatus is not limited to the laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium. However, the recording medium is not limited to paper as the sheet. In addition to paper as the sheet, the recording medium includes an overhead projector (OHP) transparency, cloth, a metal sheet, plastic film, and a prepreg sheet pre-impregnated with resin in carbon fiber.

The recording medium also includes a medium adhered with a developer and ink, recording paper, and a recording sheet. The sheet includes, in addition to plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of a construction of a laser printer as an image forming apparatus 100.

Figure 1B:
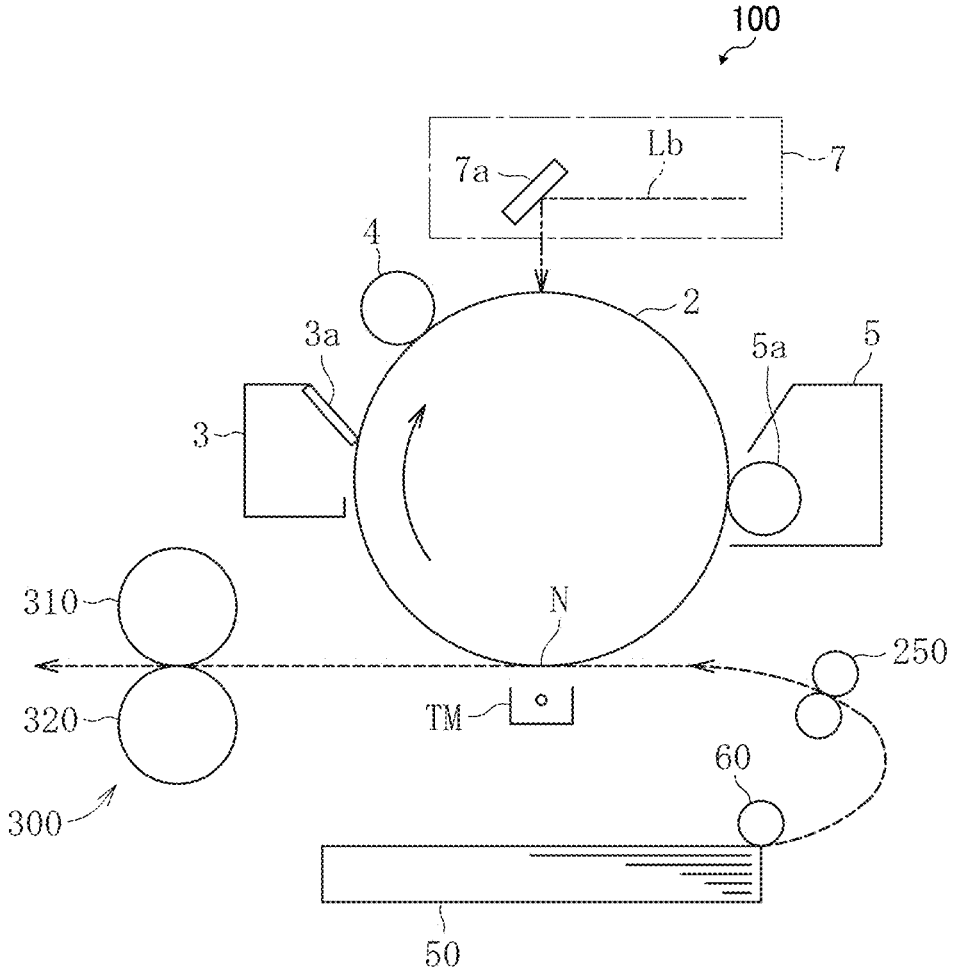
FIG. 1B is a schematic cross-sectional view of the image forming apparatus depicted in FIG. 1A, illustrating a principle thereof.

FIG. 1A is a schematic cross-sectional view of the image forming apparatus 100 that incorporates the heater or a fixing device 300 according to the embodiments of the present disclosure. FIG. 1A schematically illustrates a construction of a color laser printer as one embodiment of the image forming apparatus 100. FIG. 1B is a schematic cross-sectional view of the image forming apparatus 100, illustrating and simplifying a principle or a mechanism of the color laser printer.

As illustrated in FIG. 1A, the image forming apparatus 100 includes four process units 1K, 1Y, 1M, and 1C serving as image forming devices, respectively. The process units 1K, 1Y, 1M, and 1C form black, yellow, magenta, and cyan toner images with developers in black (K), yellow (Y), magenta (M), and cyan (C), respectively, which correspond to color separation components for a color image.

The process units 1K, 1Y, 1M, and 1C have a common construction except that the process units 1K, 1Y, 1M, and 1C include toner bottles 6K, 6Y, 6M, and 6C containing fresh toners in different colors, respectively. Hence, the following describes a construction of a single process unit, that is, the process unit 1K, and a description of a construction of each of other process units, that is, the process units 1Y, 1M, and 1C, is omitted.

The process unit 1K includes an image bearer 2K (e.g., a photoconductive drum), a drum cleaner 3K, and a discharger. The process unit 1K further includes a charger 4K and a developing device 5K. The charger 4K serves as a charging member or a charging device that uniformly charges a surface of the image bearer 2K. The developing device 5K serves as a developing member that develops an electrostatic latent image formed on the image bearer 2K into a visible image. The process unit 1K is detachably attached to a body of the image forming apparatus 100 to replace consumables of the process unit 1K with new ones.

Similarly, the process units 1Y 1M, and 1C include image bearers 2Y, 2M, and 2C, drum cleaners 3Y, 3M, and 3C, chargers 4Y, 4M, and 4C, and developing devices 5Y, 5M, and 5C, respectively. In FIG. 1B, the image bearers 2K, 2Y, 2M, and 2C, the drum cleaners 3K, 3Y, 3M, and 3C, the chargers 4K, 4Y, 4M, and 4C, and the developing devices 5K, 5Y, 5M, and 5C are indicated as an image bearer 2, a drum cleaner 3, a charger 4, and a developing device 5, respectively.

An exposure device 7 is disposed above the process units 1K, 1Y, 1M, and 1C disposed inside the image forming apparatus 100. The exposure device 7 performs scanning and writing according to image data. For example, the exposure device 7 includes a laser diode that emits a laser beam Lb according to the image data and a mirror 7*a* that reflects the laser beam Lb to the image bearer 2K so that the laser beam Lb irradiates the image bearer 2K.

According to this embodiment, a transfer device 15 is disposed below the process units 1K, 1Y, 1M, and 1C. The transfer device 15 is equivalent to a transferor TM depicted in FIG. 1B. Primary transfer rollers 19K, 19Y, 19M, and 19C are disposed opposite the image bearers 2K, 2Y, 2M, and 2C, respectively, and in contact with an intermediate transfer belt 16.

The intermediate transfer belt 16 rotates in a state in which the intermediate transfer belt 16 is looped over the primary transfer rollers 19K, 19Y, 19M, and 19C, a driving roller 18, and a driven roller 17. A secondary transfer roller 20 is disposed opposite the driving roller 18 and in contact with the intermediate transfer belt 16. The image bearers 2K, 2Y, 2M, and 2C serve as primary image bearers that bear black, yellow, magenta, and cyan toner images, respectively. The intermediate transfer belt 16 serves as a secondary image bearer that bears a composite toner image (e.g., a color toner image) formed with the black, yellow, magenta, and cyan toner images.

A belt cleaner 21 is disposed downstream from the secondary transfer roller 20 in a rotation direction of the intermediate transfer belt 16. A cleaning backup roller is disposed opposite the belt cleaner 21 via the intermediate transfer belt 16.

A sheet feeder 200 including a tray 50 depicted in FIG. 1B that loads sheets P is disposed in a lower portion of the image forming apparatus 100. The sheet feeder 200 serves as a recording medium supply that contains a plurality of sheets P in a substantial number, that is, a sheaf of sheets P, serving as recording media. The sheet feeder 200 is combined with a sheet feeding roller 60 and a roller pair 210 into a unit. The sheet feeding roller 60 and the roller pair 210 serve as separation-conveyance members that separate an uppermost sheet P from other sheets P and convey the uppermost sheet P.

The sheet feeder 200 is inserted into and removed from the body of the image forming apparatus 100 for replenishment and the like of the sheets P. The sheet feeding roller 60 and the roller pair 210 are disposed above the sheet feeder 200 and convey the uppermost sheet P of the sheaf of sheets P placed in the sheet feeder 200 toward a sheet feeding path 32.

A registration roller pair 250 serving as a conveyer is disposed immediately upstream from the secondary transfer roller 20 in a sheet conveyance direction. The registration roller pair 250 temporarily halts the sheet P sent from the sheet feeder 200. As the registration roller pair 250 temporarily halts the sheet P, the registration roller pair 250 slacks a leading end of the sheet P, correcting skew of the sheet P.

A registration sensor 31 is disposed immediately upstream from the registration roller pair 250 in the sheet conveyance direction. The registration sensor 31 detects passage of the leading end of the sheet P. When a predetermined time period elapses after the registration sensor 31 detects passage of the leading end of the sheet P, the sheet P strikes the registration roller pair 250 and halts temporarily.

Downstream from the sheet feeder 200 in the sheet conveyance direction is a conveying roller 240 that conveys the sheet P conveyed rightward from the roller pair 210 upward. As illustrated in FIG. 1A, the conveying roller 240 conveys the sheet P upward toward the registration roller pair 250.

The roller pair 210 is constructed of a pair of rollers, that is, an upper roller and a lower roller. The roller pair 210 employs a friction reverse roller (FRR) separation system or a friction roller (FR) separation system. According to the FRR separation system, a separating roller (e.g., a reverse roller) is applied with a torque in a predetermined amount in an anti-feeding direction by a driving shaft through a torque limiter. The separating roller is pressed against a feeding roller to form a nip therebetween where the uppermost sheet P is separated from other sheets P. According to the FR separation system, a separating roller (e.g., a friction roller) is supported by a securing shaft via a torque limiter. The separating roller is pressed against a feeding roller to form a nip therebetween where the uppermost sheet P is separated from other sheets P.

According to this embodiment, the roller pair 210 employs the FRR separation system. For example, the roller pair 210 includes a feeding roller 220 and a separating roller 230. The feeding roller 220 is an upper roller that conveys the sheet P to an inside of a machine. The separating roller 230 is a lower roller that is applied with a driving force in a direction opposite a rotation direction of the feeding roller 220 by a driving shaft through a torque limiter.

A biasing member such as a spring biases the separating roller 230 against the feeding roller 220. The driving force applied to the feeding roller 220 is transmitted to the sheet feeding roller 60 through a clutch, thus rotating the sheet feeding roller 60 counterclockwise in FIG. 1A.

After the leading end of the sheet P strikes the registration roller pair 250 and slacks, the registration roller pair 250 conveys the sheet P to a secondary transfer nip (e.g., a transfer nip N depicted in FIG. 1B) formed between the secondary transfer roller 20 and the intermediate transfer belt 16 pressed by the driving roller 18 at a proper time when the secondary transfer roller 20 transfers a color toner image formed on the intermediate transfer belt 16 onto the sheet P. A bias applied at the secondary transfer nip electrostatically transfers the color toner image formed on the intermediate transfer belt 16 onto a desired transfer position on the sheet P sent to the secondary transfer nip precisely.

A post-transfer conveyance path 33 is disposed above the secondary transfer nip formed between the secondary transfer roller 20 and the intermediate transfer belt 16 pressed by the driving roller 18. The fixing device 300 is disposed in proximity to an upper end of the post-transfer conveyance path 33. The fixing device 300 includes a fixing belt 310 and a pressure roller 320. The fixing belt 310 serves as a fixing rotator or a fixing member that accommodates the heater. The pressure roller 320 serves as a pressure rotator or a pressure member that rotates while the pressure roller 320 contacts the fixing belt 310 with predetermined pressure. The fixing device 300 has a construction illustrated in FIG. 2A. Alternatively, the fixing device 300 may be replaced by fixing devices 300S, 300T, and 300U that have constructions described below with reference to FIGS. 2B, 2C, and 2D, respectively.

As illustrated in FIG. 1A, a post-fixing conveyance path 35 is disposed above the fixing device 300. At an upper end of the post-fixing conveyance path 35, the post-fixing conveyance path 35 branches to a sheet ejection path 36 and a reverse conveyance path 41. A switcher 42 is disposed at a bifurcation of the post-fixing conveyance path 35. The switcher 42 pivots about a pivot shaft 42*a* as an axis. A sheet ejection roller pair 37 is disposed in proximity to an outlet edge of the sheet ejection path 36.

One end of the reverse conveyance path 41 is at the bifurcation of the post-fixing conveyance path 35. Another end of the reverse conveyance path 41 joins the sheet feeding path 32. A reverse conveyance roller pair 43 is disposed in a middle of the reverse conveyance path 41. A sheet ejection tray 44 is disposed in an upper portion of the image forming apparatus 100. The sheet ejection tray 44 includes a recess directed inward in the image forming apparatus 100.

A powder container 10 (e.g., a toner container) is interposed between the transfer device 15 and the sheet feeder 200. The powder container 10 is detachably attached to the body of the image forming apparatus 100.

The image forming apparatus 100 according to this embodiment secures a predetermined distance from the sheet feeding roller 60 to the secondary transfer roller 20 to convey the sheet P. Hence, the powder container 10 is situated in a dead space defined by the predetermined distance, downsizing the image forming apparatus 100 entirely.

A transfer cover 8 is disposed above the sheet feeder 200 at a front of the image forming apparatus 100 in a drawing direction of the sheet feeder 200. As an operator (e.g., a user and a service engineer) opens the transfer cover 8, the operator inspects an inside of the image forming apparatus 100. The transfer cover 8 mounts a bypass tray 46 and a bypass sheet feeding roller 45 used for a sheet P manually placed on the bypass tray 46 by the operator.

A description is provided of operations of the image forming apparatus 100, that is, the laser printer.

Referring to FIG. 1A, the following describes basic operations of the image forming apparatus 100 according to this embodiment, which has the construction described above to perform image formation.

First, a description is provided of operations of the image forming apparatus 100 to print on one side of a sheet P.

As illustrated in FIG. 1A, the sheet feeding roller 60 rotates according to a sheet feeding signal sent from a controller of the image forming apparatus 100. The sheet feeding roller 60 separates an uppermost sheet P from other sheets P of a sheaf of sheets P loaded in the sheet feeder 200 and feeds the uppermost sheet P to the sheet feeding path 32.

When the leading end of the sheet P sent by the sheet feeding roller 60 and the roller pair 210 reaches a nip of the registration roller pair 250, the registration roller pair 250 slacks and halts the sheet P temporarily. The registration roller pair 250 conveys the sheet P to the secondary transfer nip at an optimal time in synchronism with a time when the secondary transfer roller 20 transfers a color toner image formed on the intermediate transfer belt 16 onto the sheet P while the registration roller pair 250 corrects skew of the leading end of the sheet P.

In order to feed a sheaf of sheets P placed on the bypass tray 46, the bypass sheet feeding roller 45 conveys the sheaf of sheets P loaded on the bypass tray 46 one by one from an uppermost sheet P. The sheet P is conveyed through a part of the reverse conveyance path 41 to the nip of the registration roller pair 250. Thereafter, the sheet P is conveyed similarly to the sheet P conveyed from the sheet feeder 200.

The following describes processes for image formation with one process unit, that is, the process unit 1K, and a description of processes for image formation with other process units, that is, the process units 1Y 1M, and 1C, is omitted. First, the charger 4K uniformly charges the surface of the image bearer 2K at a high electric potential. The exposure device 7 emits a laser beam Lb that irradiates the surface of the image bearer 2K according to image data.

The electric potential of an irradiated portion on the surface of the image bearer 2K, which is irradiated with the laser beam Lb, decreases, forming an electrostatic latent image on the image bearer 2K. The developing device 5K includes a developer bearer 5*a* depicted in FIG. 1B that bears a developer containing toner. Fresh black toner supplied from the toner bottle 6K is transferred onto a portion on the surface of the image bearer 2K, which bears the electrostatic latent image, through the developer bearer 5*a*.

The surface of the image bearer 2K transferred with the black toner bears a black toner image developed with the black toner. The primary transfer roller 19K transfers the black toner image formed on the image bearer 2K onto the intermediate transfer belt 16.

A cleaning blade 3*a* depicted in FIG. 1B of the drum cleaner 3K removes residual toner failed to be transferred onto the intermediate transfer belt 16 and therefore adhered on the surface of the image bearer 2K therefrom. The removed residual toner is conveyed by a waste toner conveyer and collected into a waste toner container disposed inside the process unit 1K. The discharger removes residual electric charge from the image bearer 2K from which the drum cleaner 3K has removed the residual toner.

Similarly, in the process units 1Y, 1M, and 1C, yellow, magenta, and cyan toner images are formed on the image bearers 2Y, 2M, and 2C, respectively. The primary transfer rollers 19Y, 19M, and 19C transfer the yellow, magenta, and cyan toner images formed on the image bearers 2Y, 2M, and 2C, respectively, onto the intermediate transfer belt 16 such that the yellow, magenta, and cyan toner images are superimposed on the intermediate transfer belt 16.

The black, yellow, magenta, and cyan toner images transferred and superimposed on the intermediate transfer belt 16 travel to the secondary transfer nip formed between the secondary transfer roller 20 and the intermediate transfer belt 16 pressed by the driving roller 18. On the other hand, the registration roller pair 250 resumes rotation at a predetermined time while sandwiching a sheet P that strikes the registration roller pair 250. The registration roller pair 250 conveys the sheet P to the secondary transfer nip formed between the secondary transfer roller 20 and the intermediate transfer belt 16 at a time when the secondary transfer roller 20 transfers the black, yellow, magenta, and cyan toner images superimposed on the intermediate transfer belt 16 properly. Thus, the secondary transfer roller 20 transfers the black, yellow, magenta, and cyan toner images superimposed on the intermediate transfer belt 16 onto the sheet P conveyed by the registration roller pair 250, forming a color toner image on the sheet P.

The sheet P transferred with the color toner image is conveyed to the fixing device 300 through the post-transfer conveyance path 33. The fixing belt 310 and the pressure roller 320 sandwich the sheet P conveyed to the fixing device 300 and fix the unfixed color toner image on the sheet P under heat and pressure. The sheet P bearing the fixed color toner image is conveyed from the fixing device 300 to the post-fixing conveyance path 35.

When the sheet P is sent out of the fixing device 300, the switcher 42 opens the upper end of the post-fixing conveyance path 35 and a vicinity thereof as illustrated with a solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing printing on one side of the sheet P.

Next, a description is provided of operations of the image forming apparatus 100 to perform duplex printing.

Similarly to printing on one side of the sheet P, the fixing device 300 sends out the sheet P to the sheet ejection path 36. In order to perform duplex printing, the sheet ejection roller pair 37 is driven and rotated to convey a part of the sheet P to an outside of the image forming apparatus 100.

When a trailing end of the sheet P has passed through the sheet ejection path 36, the switcher 42 pivots about the pivot shaft 42*a* as illustrated with a dotted line in FIG. 1A, closing the upper end of the post-fixing conveyance path 35. Approximately simultaneously with closing of the upper end of the post-fixing conveyance path 35, the sheet ejection roller pair 37 rotates in a direction opposite a direction in which the sheet ejection roller pair 37 conveys the sheet P onto the outside of the image forming apparatus 100, thus conveying the sheet P to the reverse conveyance path 41.

The sheet P conveyed to the reverse conveyance path 41 travels to the registration roller pair 250 through the reverse conveyance roller pair 43. The registration roller pair 250 conveys the sheet P to the secondary transfer nip at a proper time when the secondary transfer roller 20 transfers black, yellow, magenta, and cyan toner images superimposed on the intermediate transfer belt 16 onto a back side of the sheet P, which is transferred with no toner image, that is, in synchronism with reaching of the black, yellow, magenta, and cyan toner images to the secondary transfer nip.

While the sheet P passes through the secondary transfer nip, the secondary transfer roller 20 and the driving roller 18 transfer the black, yellow, magenta, and cyan toner images onto the back side of the sheet P, which is transferred with no toner image, thus forming a color toner image on the sheet P. The sheet P transferred with the color toner image is conveyed to the fixing device 300 through the post-transfer conveyance path 33.

In the fixing device 300, the fixing belt 310 and the pressure roller 320 sandwich the sheet P conveyed to the fixing device 300 and fix the unfixed color toner image on the back side of the sheet P under heat and pressure. The sheet P bearing the color toner image fixed on both sides, that is, a front side and the back side of the sheet P, is conveyed from the fixing device 300 to the post-fixing conveyance path 35.

When the sheet P is sent out of the fixing device 300, the switcher 42 opens the upper end of the post-fixing conveyance path 35 and the vicinity thereof as illustrated with the solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing duplex printing on the sheet P.

After the secondary transfer roller 20 transfers the black, yellow, magenta, and cyan toner images superimposed on the intermediate transfer belt 16 onto the sheet P, residual toner adheres to the intermediate transfer belt 16. The belt cleaner 21 removes the residual toner from the intermediate transfer belt 16. The residual toner removed from the intermediate transfer belt 16 is conveyed by the waste toner conveyer and collected into the powder container 10.

A description is provided of a construction of each of a heater 91 and the fixing devices 300, 300S, 300T, and 300U according to a first embodiment, a second embodiment, a third embodiment, and a fourth embodiment, respectively, of the present disclosure.

Figure 2A:
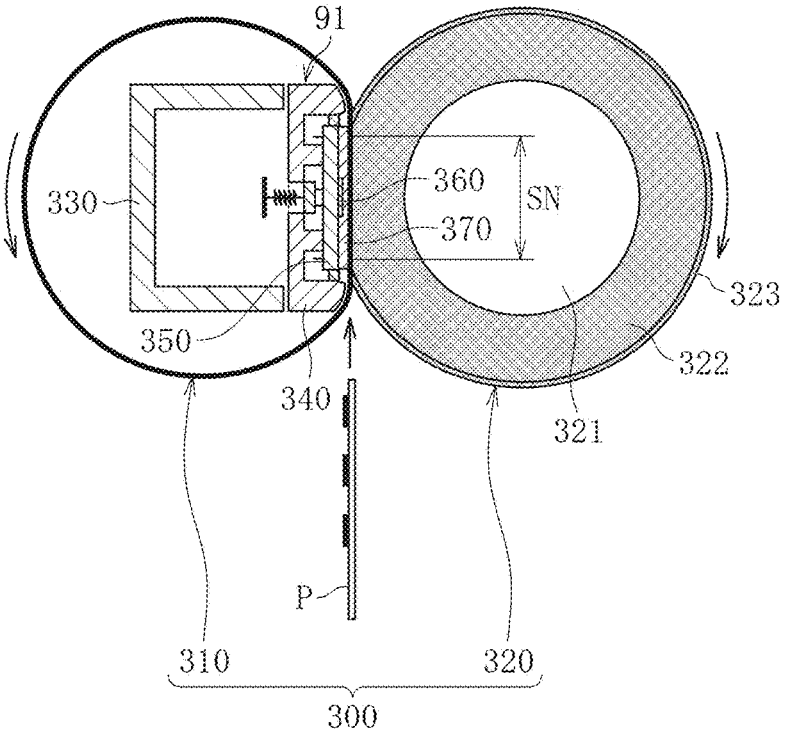

The following describes the construction of the heater 91 of the fixing device 300 according to the first embodiment, which is also installable in the fixing devices 300S, 300T, and 300U. As illustrated in FIG. 2A, the heater 91 according to this embodiment heats the fixing belt 310 of the fixing device 300.

As illustrated in FIG. 2A, the fixing device 300 according to the first embodiment includes the fixing belt 310 that is thin and has a decreased thermal capacity and the pressure roller 320.

A detailed description is now given of a construction of the fixing belt 310.

The fixing belt 310 includes a tubular base that is made of polyimide (PI) and has an outer diameter of 25 mm and a thickness in a range of from 40 micrometers to 120 micrometers, for example.

The fixing belt 310 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 310 and facilitate separation of the sheet P and a foreign substance from the fixing belt 310. Optionally, an elastic layer that is made of rubber or the like and has a thickness in a range of from 50 micrometers to 500 micrometers may be interposed between the base and the release layer.

The base of the fixing belt 310 may be made of heat resistant resin such as polyetheretherketone (PEEK) or metal such as nickel (Ni) and SUS stainless steel, instead of polyimide. An inner circumferential surface of the fixing belt 310 may be coated with polyimide, PTFE, or the like to produce a slide layer.

A detailed description is now given of a construction of the pressure roller 320.

The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has a thickness of 3.5 mm, for example. In order to facilitate separation of the sheet P and the foreign substance from the pressure roller 320, the release layer 323 that is made of fluororesin and has a thickness of about 40 micrometers, for example, is preferably disposed on the outer surface of the elastic layer 322. A biasing member presses the pressure roller 320 against the fixing belt 310.

A stay 330 and a holder 340 are disposed inside a loop formed by the fixing belt 310 and extended in an axial direction of the fixing belt 310. The stay 330 includes a channel made of metal. Both lateral ends of the stay 330 in a longitudinal direction thereof are supported by side plates of the fixing device 300, respectively. The stay 330 receives pressure from the pressure roller 320 precisely to form a fixing nip SN between the fixing belt 310 and the pressure roller 320 stably.

The holder 340 holds a base 350 of the heater 91 and is supported by the stay 330. The holder 340 is preferably made of heat resistant resin having a decreased thermal conductivity, such as liquid crystal polymer (LCP). Accordingly, the holder 340 reduces conduction of heat thereto, improving heating of the fixing belt 310.

In order to prevent contact with a high temperature portion of the base 350, the holder 340 has a shape that supports the base 350 at two positions in proximity to both ends of the base 350, respectively, in a short direction thereof. Accordingly, the holder 340 reduces conduction of heat thereto further, improving heating of the fixing belt 310.

As illustrated in FIG. 2A, as the sheet P conveyed in a direction indicated by an arrow passes through the fixing nip SN, the fixing belt 310 and the pressure roller 320 sandwich the sheet P and fix the toner image on the sheet P under heat. While the fixing belt 310 slides over an insulating layer 370 covering a resistive heat generator 360, the resistive heat generator 360 heats the fixing belt 310.

A description is provided of variations of the fixing device 300.

The fixing device 300 according to the first embodiment depicted in FIG. 2A provides variations thereof.

Figure 2B:
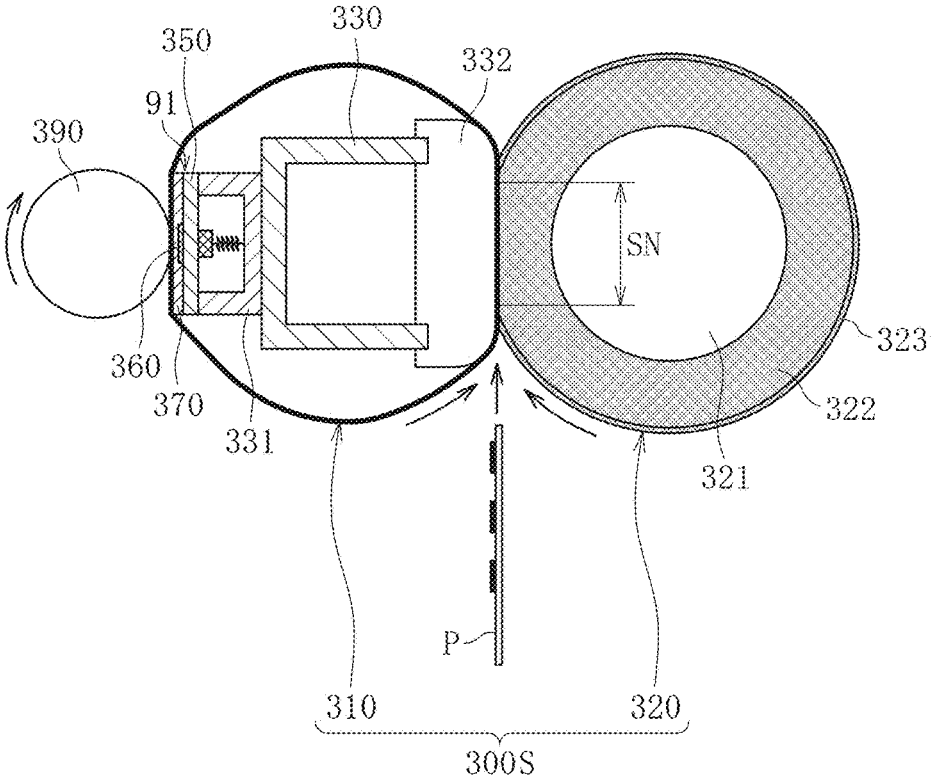
FIG. 2B is a cross-sectional view of a fixing device according to a second embodiment of the present disclosure, which is installable in the image forming apparatus depicted in FIG. 1A.
Figure 2C:
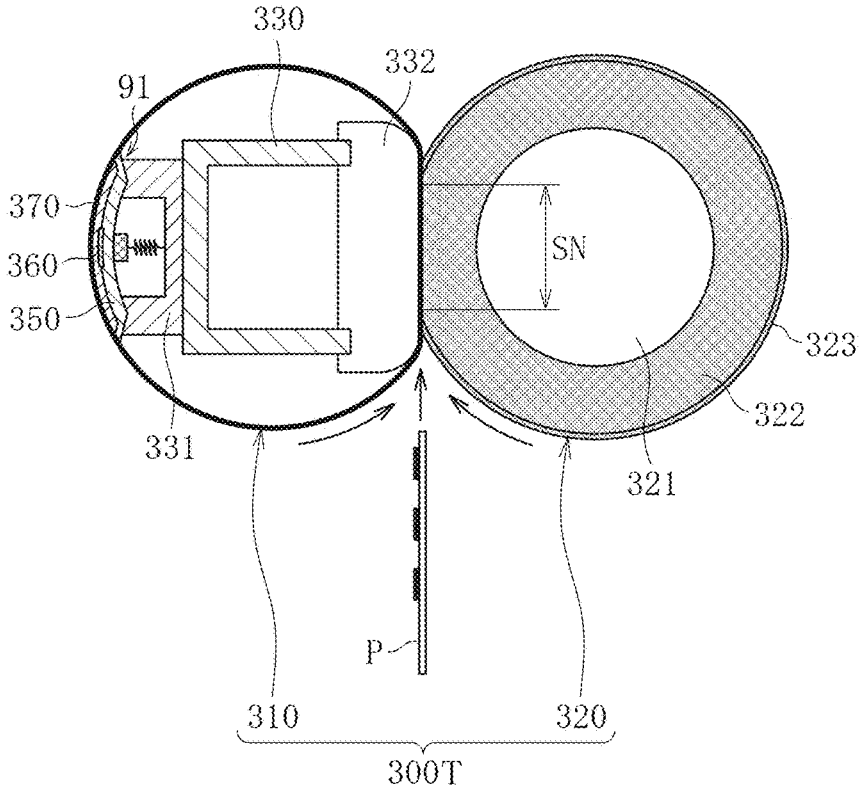
FIG. 2C is a cross-sectional view of a fixing device according to a third embodiment of the present disclosure, which is installable in the image forming apparatus depicted in FIG. 1A.
Figure 2D:
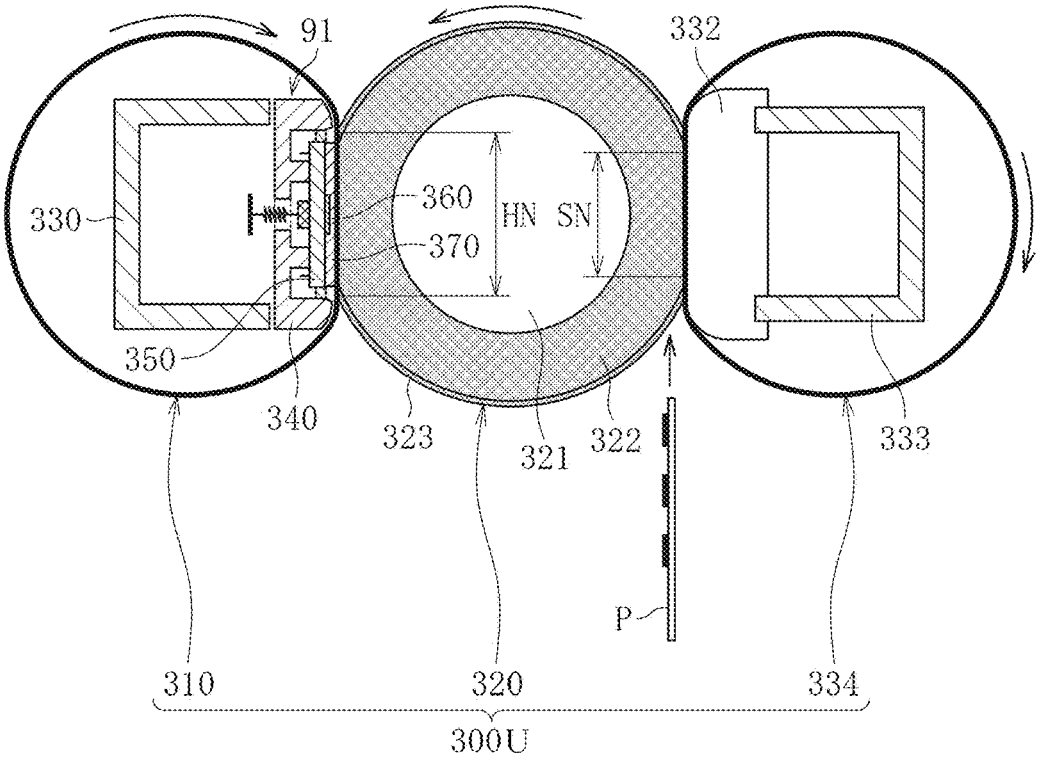
FIG. 2D is a cross-sectional view of a fixing device according to a fourth embodiment of the present disclosure, which is installable in the image forming apparatus depicted in FIG. 1A.

Referring to FIGS. 2B, 2C, and 2D, the following describes a construction of each of the fixing devices 300S, 300T, and 300U according to the second embodiment, the third embodiment, and the fourth embodiment, respectively.

As illustrated in FIG. 2B, the fixing device 300S according to the second embodiment includes a pressing roller 390 disposed opposite the pressure roller 320 via the fixing belt 310. The pressing roller 390 and the heater 91 sandwich the fixing belt 310 such that the heater 91 heats the fixing belt 310.

The heater 91 is disposed inside the loop formed by the fixing belt 310. A supplementary stay 331 is mounted on a first side of the stay 330. A nip forming pad 332 serving as a nip former is mounted on a second side of the stay 330, which is opposite the first side thereof. The heater 91 is supported by the supplementary stay 331. The pressure roller 320 is pressed against the nip forming pad 332 via the fixing belt 310 to form the fixing nip SN between the fixing belt 310 and the pressure roller 320.

As illustrated in FIG. 2C, the fixing device 300T according to the third embodiment includes the heater 91 disposed inside the loop formed by the fixing belt 310. Since the fixing device 300T eliminates the pressing roller 390 described above with reference to FIG. 2B, in order to increase the length for which the heater 91 contacts the fixing belt 310 in a circumferential direction thereof, the base 350 and the insulating layer 370 of the heater 91 are curved into an arc in cross section that corresponds to a curvature of the fixing belt 310. The resistive heat generator 360 is disposed at a center of the base 350, that is arc-shaped, in the circumferential direction of the fixing belt 310. Except for elimination of the pressing roller 390 and the shape of the heater 91, the fixing device 300T according to the third embodiment is equivalent to the fixing device 300S according to the second embodiment depicted in FIG. 2B.

As illustrated in FIG. 2D, the fixing device 300U according to the fourth embodiment defines a heating nip HN separately from the fixing nip SN. For example, the nip forming pad 332 and a stay 333 that includes a channel made of metal are disposed opposite the fixing belt 310 via the pressure roller 320. A pressure belt 334 that is rotatable accommodates the nip forming pad 332 and the stay 333. As a sheet P bearing a toner image is conveyed through the fixing nip SN formed between the pressure belt 334 and the pressure roller 320, the pressure belt 334 and the pressure roller 320 heat and fix the toner image on the sheet P. Except for the pressure belt 334 accommodating the nip forming pad 332 and the stay 333, the fixing device 300U according to the fourth embodiment is equivalent to the fixing device 300 according to the first embodiment depicted in FIG. 2A.

A description is provided of a construction of the heater 91 according to a first embodiment of the present disclosure.

Figure 3A:
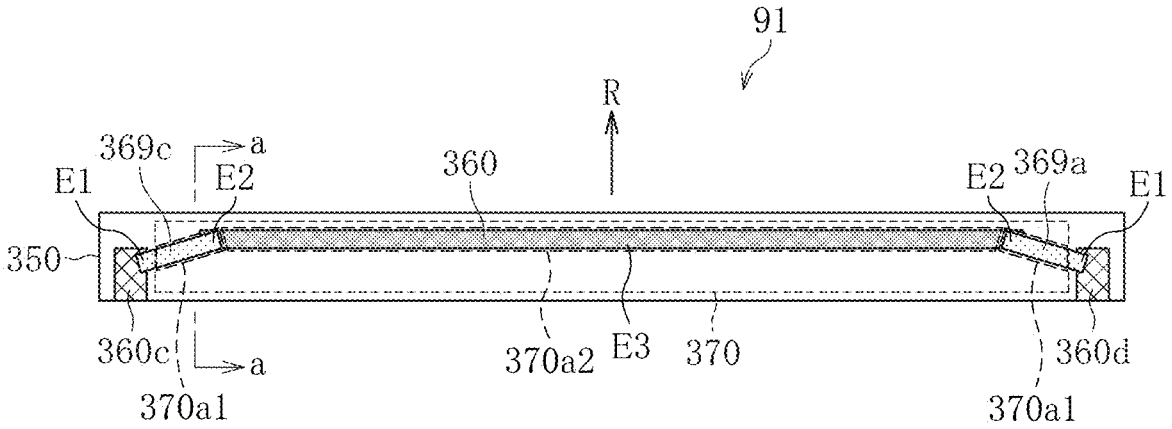
FIG. 3A is a plan view of a heater according to a first embodiment of the present disclosure, which is incorporated in the fixing device depicted in FIG. 2A.
Figure 3B:
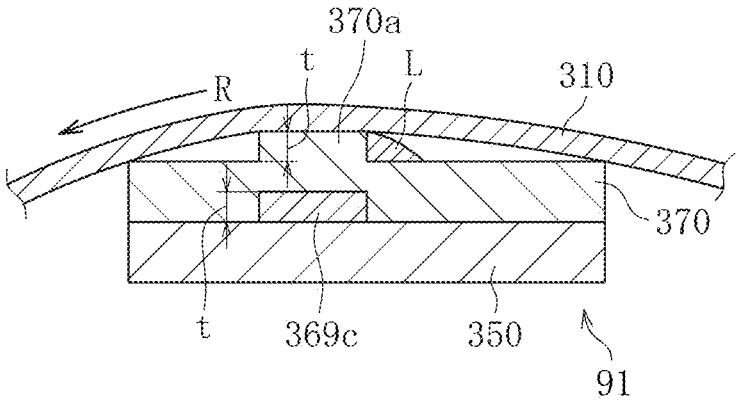
FIG. 3B is a cross-sectional view of the heater depicted in FIG. 3A.

FIGS. 3A and 3B illustrate the heater 91 according to the first embodiment. FIG. 3A is a plan view of the heater 91. FIG. 3B is a cross-sectional view of the heater 91 taken on line a-a in FIG. 3A. As illustrated in FIG. 3A, the heater 91 includes the resistive heat generator 360. The resistive heat generator 360 is mounted on the base 350. The base 350 includes an elongate, thin metal plate and an insulator that coats the metal plate.

The base 350 is preferably made of aluminum, stainless steel, or the like that is available at reduced costs. Alternatively, instead of metal, the base 350 may be made of ceramic such as alumina and aluminum nitride or a nonmetallic material that has an increased heat resistance and an increased insulation such as glass and mica.

In order to improve evenness of heat generated by the heater 91 so as to enhance quality of an image formed on a sheet P, the base 350 may be made of a material that has an increased thermal conductivity such as copper, graphite, and graphene. According to this embodiment, the base 350 is made of alumina and has a short width of 8 mm, a longitudinal width of 270 mm, and a thickness of 1.0 mm.

The resistive heat generator 360 is disposed in proximity to a downstream edge of the base 350 in a rotation direction R of the fixing belt 310. For example, the resistive heat generator 360 is disposed opposite a downstream part of the fixing nip SN in the rotation direction R of the fixing belt 310. The resistive heat generator 360 is linear in a longitudinal direction of the base 350. Both lateral ends of the resistive heat generator 360 that is linear are connected to electrodes 360*c* and 360*d* through feeders 369*c* and 369*a*, respectively. The feeders 369*c* and 369*a*, having a decreased resistance value, are disposed at both lateral ends of the base 350 in the longitudinal direction thereof, respectively. The electrodes 360*c* and 360*d* supply power to the resistive heat generator 360. The electrodes 360*c* and 360*d* are coupled to a power supply including an alternating current power supply.

Each of the feeders 369*a* and 369*c* includes an inboard end E2 and an outboard end E1 in a longitudinal direction thereof. Each of the feeders 369*a* and 369*c* is inclined such that the inboard end E2 is disposed downstream from the outboard end E1 in the rotation direction R of the fixing belt 310. Each of the feeders 369*a* and 369*c* has an angle of inclination of about 30 degrees relative to the longitudinal direction of the base 350 in FIG. 3A as one example.

Each of the resistive heat generator 360 and the feeders 369*a* and 369*c* is produced by screen printing to have a predetermined line width and a predetermined thickness. The resistive heat generator 360 is produced as below. Silver (Ag) or silver-palladium (AgPd) and glass powder and the like are mixed into paste. The paste coats the base 350 by screen printing or the like. Thereafter, the base 350 is subject to firing. Alternatively, the resistive heat generator 360 may be made of a resistive material such as a silver alloy (AgPt) and ruthenium oxide ($RuO_2$).

As illustrated in FIG. 3B, an overcoat layer or the insulating layer 370, serving as a thin slide layer, covers a surface of each of the resistive heat generator 360 and the feeders 369*a* and 369*c*. The insulating layer 370 attains insulation between the fixing belt 310 and the resistive heat generator 360 and between the fixing belt 310 and the feeders 369*a* and 369*c* while facilitating sliding of the fixing belt 310 over the insulating layer 370.

For example, the insulating layer 370 is made of heat resistant glass and has a thickness of 75 micrometers. The resistive heat generator 360 heats the fixing belt 310 that contacts the insulating layer 370 by conduction of heat, increasing the temperature of the fixing belt 310 so that the fixing belt 310 heats and fixes the unfixed toner image on the sheet P conveyed through the fixing nip SN.

As illustrated in FIG. 3B, the resistive heat generator 360 and the feeders 369*a* and 369*c* have a predetermined film thickness t on a surface of the base 350. The predetermined film thickness t produces a projecting portion 370*a* having a height defined by the predetermined film thickness t. The projecting portion 370*a* defines a surface of the insulating layer 370 and is disposed opposite the resistive heat generator 360 and the feeders 369*a* and 369*c*.

As illustrated in FIG. 3A, the projecting portion 370*a* includes upstream projections 370*al* and a downstream projection 370*a*2. The upstream projections 370*al* are disposed opposite both lateral ends of the base 350 in the longitudinal direction thereof and disposed on the feeders 369*a* and 369*c*, respectively. For example, the feeders 369*a* and 369*c* define the upstream projections 370*al*, respectively. The downstream projection 370*a*2 is disposed downstream from the upstream projections 370*al* in the rotation direction R of the fixing belt 310. The downstream projection 370*a*2 is disposed opposite a center of the base 350 in the longitudinal direction thereof and disposed on the resistive heat generator 360. For example, the resistive heat generator 360 defines the downstream projection 370*a*2. The upstream projections 370*a*1 and the downstream projection 370*a*2 are preferably symmetric with respect to a center position of the base 350 in the longitudinal direction thereof. Alternatively, the upstream projections 370*al* and the downstream projection 370*a*2 may not be symmetric.

As illustrated in FIG. 3B, the projecting portion 370*a* has angular shoulders in the rotation direction R of the fixing belt 310 as one example. Alternatively, as described below with reference to FIGS. 11B and 11C, the projecting portion 370*a* may have round shoulders in the rotation direction R of the fixing belt 310. Yet alternatively, the projecting portion 370*a* may be bulged overall into an arc.

The upstream projections 370*al* disposed on both lateral ends of the base 350 in the longitudinal direction thereof scrape and move a lubricant L adhered to the inner circumferential surface of the fixing belt 310 from both lateral ends of the fixing belt 310 toward a center of the fixing belt 310 in a width direction, that is, the axial direction, of the fixing belt 310. Accordingly, unlike general fixing devices, even when the fixing belt 310 receives pressure from the pressure roller 320 at the fixing nip SN, the lubricant L does not leak from both lateral ends of the fixing belt 310 in the width direction thereof. Consequently, the fixing device 300 does not suffer from shortage of the lubricant L over time, preventing a driving torque between the fixing belt 310 and the pressure roller 320 from increasing.

A description is provided of a construction of a heater 91S according to a second embodiment of the present disclosure.

Figure 4A:
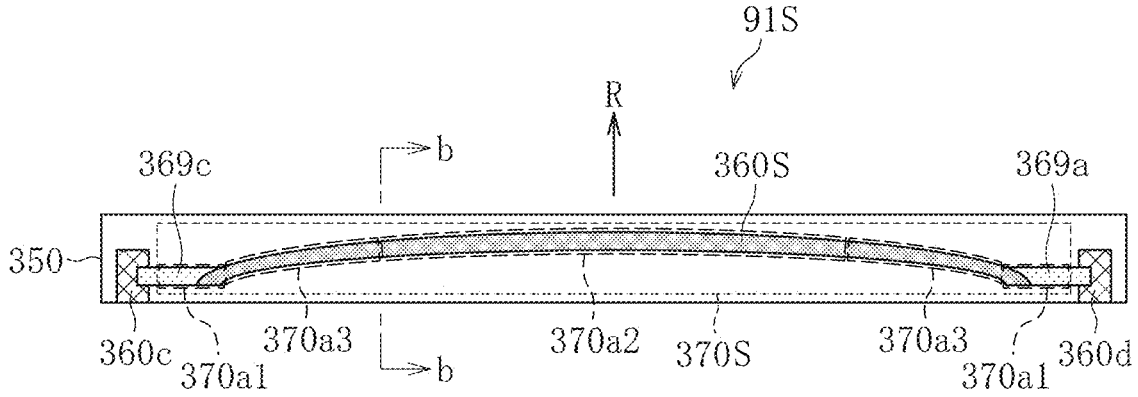
FIG. 4A is a plan view of a heater according to a second embodiment of the present disclosure, which is installable in the fixing device depicted in FIG. 2A.
Figure 4B:
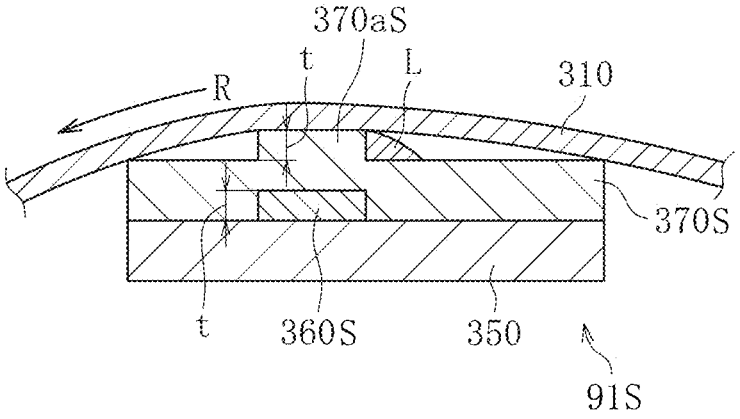
FIG. 4B is a cross-sectional view of the heater depicted in FIG. 4A.

FIGS. 4A and 4B illustrate the heater 91S according to the second embodiment. FIG. 4A is a plan view of the heater 91S. FIG. 4B is a cross-sectional view of the heater 91S taken on line b-b in FIG. 4A. The heater 91S includes a resistive heat generator 360S that is bent into an arc (e.g., a bow). For example, a center of the resistive heat generator 360S in a longitudinal direction thereof is bulged downstream in the rotation direction R of the fixing belt 310, thus defining an arc.

Since the resistive heat generator 360S defines the arc, the heater 91S includes an insulating layer 370S that includes a projecting portion 370*a*S. The projecting portion 370*a*S includes the upstream projections 370*a*1, the downstream projection 370*a*2, and intermediate projections 370*a*3. The upstream projections 370*al* are disposed opposite both lateral ends of the base 350 in the longitudinal direction thereof, respectively. The downstream projection 370*a*2 is disposed downstream from the upstream projections 370*al* in the rotation direction R of the fixing belt 310 and is disposed opposite the center of the base 350 in the longitudinal direction thereof. Each of the intermediate projections 370*a*3 is interposed between the upstream projection 370*al* and the downstream projection 370*a*2. Each of the intermediate projections 370*a*3 couples the upstream projection 370*al* with the downstream projection 370*a*2. The upstream projections 370*al* and the downstream projection 370*a*2 are preferably symmetric with respect to the center position of the base 350 in the longitudinal direction thereof. Alternatively, the upstream projections 370*al* and the downstream projection 370*a*2 may not be symmetric.

Since the resistive heat generator 360S is arcuate, the projecting portion 370*a*S scrapes and moves the lubricant L adhered to the inner circumferential surface of the fixing belt 310 toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

A description is provided of a construction of a heater 91T according to a third embodiment of the present disclosure.

Figure 5:
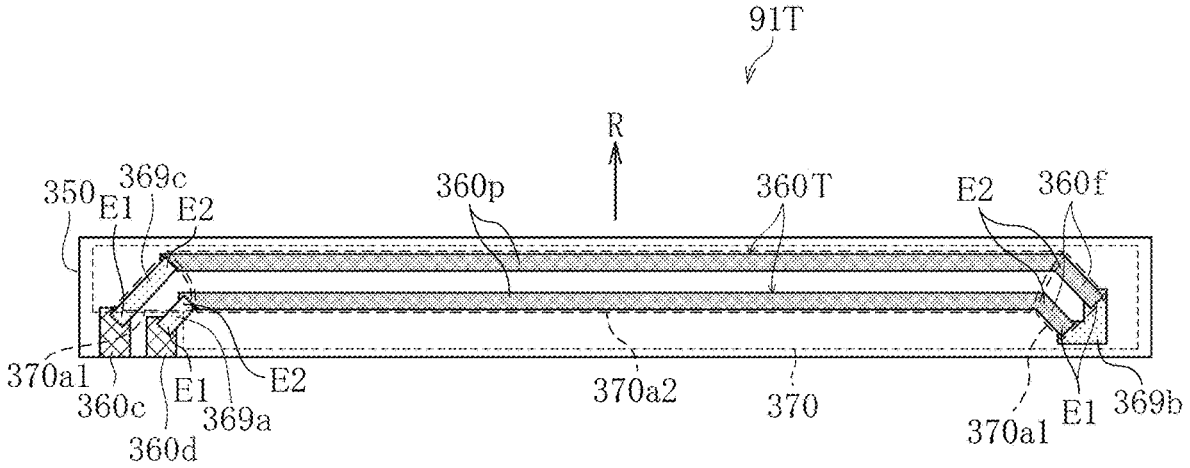
FIG. 5 is a plan view of a heater according to a third embodiment of the present disclosure, which is installable in the fixing device depicted in FIG. 2A.

FIG. 5 illustrates the heater 91T according to the third embodiment. As illustrated in FIG. 5, the heater 91T includes resistive heat generators 360T extended linearly in the longitudinal direction of the base 350 in two lines in parallel to each other. One lateral end of each of the resistive heat generators 360T in a longitudinal direction thereof, that are arranged in two lines, is connected to the electrodes 360*c* and 360*d* through the feeders 369*c* and 369*a*, respectively. The feeders 369*a* and 369*c*, having the decreased resistance value, are disposed on one lateral end of the base 350 in the longitudinal direction thereof. The electrodes 360*c* and 360*d* supply power to the resistive heat generators 360T.

Another lateral end of each of the resistive heat generators 360T in the longitudinal direction thereof is coupled to the feeder 369*b* such that the resistive heat generators 360T are turned at the feeder 369*b*. For example, the resistive heat generators 360T are turned such that one of the resistive heat generators 360T extends in a first direction toward the feeder 369*b* and another one of the resistive heat generators 360T extends from the feeder 369*b* in a second direction opposite the first direction. The feeder 369*b*, having the decreased resistance value, is disposed on another lateral end of the base 350 in the longitudinal direction thereof.

Each of the resistive heat generators 360T includes a lateral end portion 360*f* coupled to the feeder 369*b*. The feeders 369*a* and 369*c* are coupled to the electrodes 360*d* and 360*c*, respectively. Each of the lateral end portions 360*f* and the feeders 369*a* and 369*c* includes the inboard end E2 and the outboard end E1 in the longitudinal direction of the base 350. Each of the lateral end portions 360*f* and the feeders 369*a* and 369*c* is inclined such that the inboard end E2 is disposed downstream from the outboard end E1 in the rotation direction R of the fixing belt 310. Each of the lateral end portions 360*f* and the feeders 369*a* and 369*c* has an angle of inclination of about 30 degrees relative to the longitudinal direction of the base 350 in FIG. 5 as one example.

The heater 91T includes the insulating layer 370 including the upstream projections 370*al* and the downstream projection 370*a*2 which define the surface of the insulating layer 370. One of the upstream projections 370*a*1 is disposed on the feeders 369*a* and 369*c* that are inclined. Another one of the upstream projections 370*al* is disposed on the lateral end portions 360*f* of the resistive heat generators 360T, respectively, that are inclined. The downstream projection 370*a*2 is disposed downstream from the upstream projections 370*a*1 in the rotation direction R of the fixing belt 310. The downstream projection 370*a*2 is disposed on parallel portions 360*p* of the resistive heat generators 360T arranged in two lines in parallel, respectively. The upstream projections 370*a*1 and the downstream projection 370*a*2 are preferably symmetric with respect to the center position of the base 350 in the longitudinal direction thereof. Alternatively, the upstream projections 370*a*1 and the downstream projection 370*a*2 may not be symmetric.

The upstream projections 370*a*1 and the downstream projection 370*a*2 scrape and move the lubricant L applied to the inner circumferential surface of the fixing belt 310 at both lateral ends in the width direction thereof toward the center of the fixing belt 310 in the width direction thereof, like the upstream projections 370*al* and the downstream projection 370*a*2 according to the first embodiment depicted in FIGS. 3A and 3B. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

A description is provided of a construction of a heater 91U according to a fourth embodiment of the present disclosure.

Figure 6:
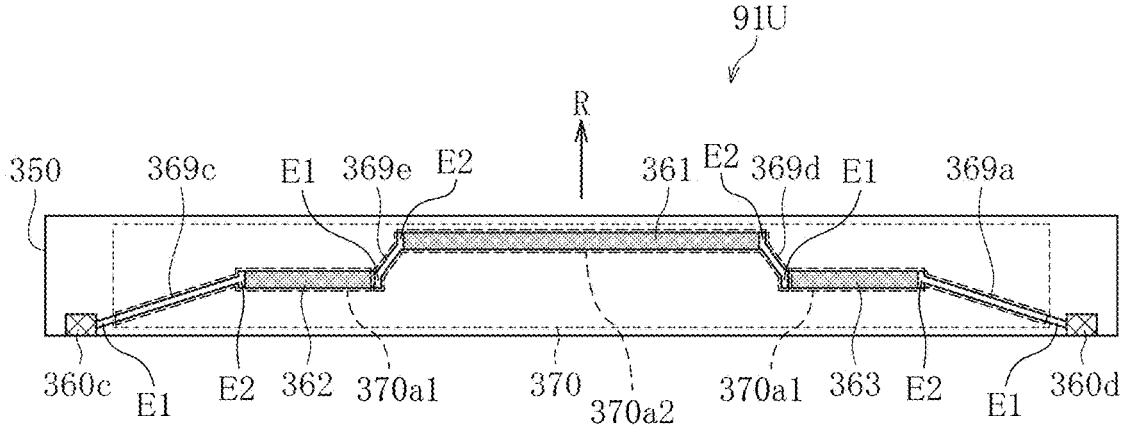
FIG. 6 is a plan view of a heater according to a fourth embodiment of the present disclosure, which is installable in the fixing device depicted in FIG. 2A.

FIG. 6 illustrates the heater 91U according to the fourth embodiment. The heater 91U includes three laminated, resistive heat generators 361, 362, and 363 that are connected in series. The three laminated, resistive heat generators 361, 362, and 363 are arranged to produce difference in level, thus defining steps shifted in the rotation direction R of the fixing belt 310.

For example, the resistive heat generator 361 is disposed on the center of the base 350 in the longitudinal direction thereof. The two resistive heat generators 362 and 363 are disposed on both lateral ends of the base 350 in the longitudinal direction thereof, respectively, and disposed upstream from the resistive heat generator 361 in the rotation direction R of the fixing belt 310. The resistive heat generator 361 disposed on the center of the base 350 in the longitudinal direction thereof is connected to the resistive heat generators 362 and 363 disposed on both lateral ends of the base 350 in the longitudinal direction thereof through feeders 369*e* and 369*d*, respectively. The resistive heat generators 362 and 363 disposed on both lateral ends of the base 350 in the longitudinal direction thereof, respectively, are connected to the electrodes 360*c* and 360*d* through the feeders 369*c* and 369*a*, respectively. The electrodes 360*c* and 360*d* supply power to the resistive heat generators 362 and 363, respectively.

Each of the feeders 369*a*, 369*c*, 369*d*, and 369*e* includes the inboard end E2 and the outboard end E1 in the longitudinal direction of the base 350. Each of the feeders 369*a*, 369*c*, 369*d*, and 369*e* is inclined such that the inboard end E2 is disposed downstream from the outboard end E1 in the rotation direction R of the fixing belt 310. The heater 91U includes the insulating layer 370 including the upstream projections 370*al* and the downstream projection 370*a*2 which define the surface of the insulating layer 370. One of the upstream projections 370*al* is disposed on the feeder 369*a* that is inclined and the resistive heat generator 363 that is disposed upstream from the resistive heat generator 361 in the rotation direction R of the fixing belt 310. Another one of the upstream projections 370*a*1 is disposed on the feeder 369*c* that is inclined and the resistive heat generator 362 that is disposed upstream from the resistive heat generator 361 in the rotation direction R of the fixing belt 310. The downstream projection 370*a*2 is disposed on the feeders 369*d* and 369*e* that are inclined and the resistive heat generator 361 that is disposed downstream from the resistive heat generators 362 and 363 in the rotation direction R of the fixing belt 310. The upstream projections 370*al* and the downstream projection 370*a*2 are preferably symmetric with respect to the center position of the base 350 in the longitudinal direction thereof. Alternatively, the upstream projections 370*al* and the downstream projection 370*a*2 may not be symmetric.

Also in the heater 91U according to the fourth embodiment depicted in FIG. 6, like in the heater 91 according to the first embodiment depicted in FIGS. 3A an 3B, the upstream projections 370*al* and the downstream projection 370*a*2 scrape and move the lubricant L adhered to the inner circumferential surface of the fixing belt 310 at both lateral ends in the width direction thereof toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

A description is provided of a construction of a heater 91V according to a fifth embodiment of the present disclosure.

Figure 7:
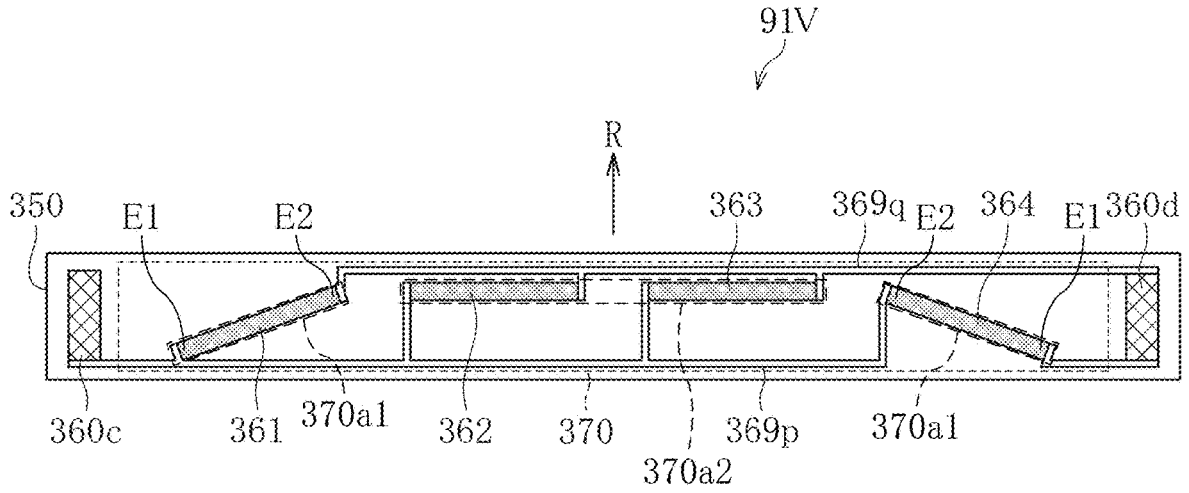
FIG. 7 is a plan view of a heater according to a fifth embodiment of the present disclosure, which is installable in the fixing device depicted in FIG. 2A.

FIG. 7 illustrates the heater 91V according to the fifth embodiment. The heater 91V includes four laminated, resistive heat generators 361 to 364, each of which has a strip shape. The resistive heat generators 361 to 364 are connected in parallel. For example, a feeder 369*p* is coupled to the electrode 360*c* that is disposed on one lateral end of the base 350 in the longitudinal direction thereof and supplies power to the resistive heat generators 361 to 364. The feeder 369*p* is coupled to one lateral end (e.g., a left end in FIG. 7) of each of the resistive heat generators 361 to 364. A feeder 369*q* is coupled to the electrode 360*d* that is disposed on another lateral end of the base 350 in the longitudinal direction thereof and supplies power to the resistive heat generators 361 to 364. The feeder 369*q* is coupled to another lateral end (e.g., a right end in FIG. 7) of each of the resistive heat generators 361 to 364.

Each of the resistive heat generators 361 and 364 disposed on both lateral ends of the base 350 in the longitudinal direction thereof, respectively, includes the inboard end E2 and the outboard end E1 in the longitudinal direction of the base 350. Each of the resistive heat generators 361 and 364 is inclined such that the inboard end E2 is disposed downstream from the outboard end E1 in the rotation direction R of the fixing belt 310. The heater 91V includes the insulating layer 370 including the upstream projections 370*al* and the downstream projection 370*a*2. The upstream projections 370*al* are disposed on the resistive heat generators 361 and 364, respectively. The downstream projection 370*a*2 is disposed downstream from the upstream projections 370*a*1 in the rotation direction R of the fixing belt 310. The downstream projection 370*a*2 is disposed on the resistive heat generators 362 and 363 that are interposed between the resistive heat generators 361 and 364. The upstream projections 370*al* and the downstream projection 370*a*2 are preferably symmetric with respect to the center position of the base 350 in the longitudinal direction thereof. Alternatively, the upstream projections 370*al* and the downstream projection 370*a*2 may not be symmetric.

Also in the heater 91V according to the fifth embodiment depicted in FIG. 7, the upstream projections 370*a*1 defined by the resistive heat generators 361 and 364, respectively, scrape and move the lubricant L applied to the inner circumferential surface of the fixing belt 310 at both lateral ends in the width direction thereof toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing. In order to prevent the feeders 369*p* and 369*q* from hindering the resistive heat generators 361 and 364 disposed on both lateral ends of the base 350 in the longitudinal direction thereof from moving the lubricant L toward the center of the fixing belt 310 in the axial direction thereof, a film thickness of each of the feeders 369*p* and 369*q* may be smaller than a film thickness of each of the resistive heat generators 361 and 364.

Each of the four resistive heat generators 361 to 364 may include a positive temperature coefficient (PTC) element that has a positive temperature coefficient of resistance. The PTC element has a property that the resistance value increases as a temperature T increases. After a plurality of small sheets P is conveyed over the fixing belt 310, for example, the temperature of the PTC element disposed opposite a non-conveyance span where the plurality of small sheets P is not conveyed may increase. In this case, a heat generation amount of the PTC element decreases because the resistance value of the PTC element varies depending on the temperature, thus suppressing temperature increase of the PTC element. Hence, the fixing device 300 suppresses temperature increase of the fixing belt 310 in the non-conveyance span while retaining the printing speed.

A description is provided of a construction of a heater 91W according to a sixth embodiment of the present disclosure.

Figure 8:
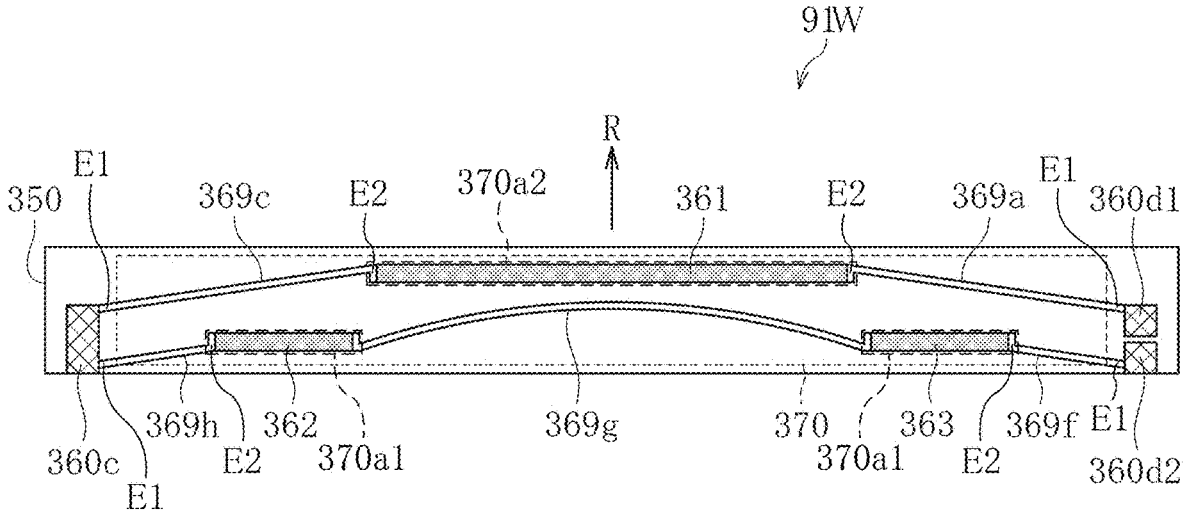
FIG. 8 is a plan view of a heater according to a sixth embodiment of the present disclosure, which is installable in the fixing device depicted in FIG. 2A.

FIG. 8 illustrates the heater 91W according to the sixth embodiment. The heater 91W includes the three laminated, resistive heat generators 361, 362, and 363, each of which has a strip shape. The resistive heat generator 361 is disposed on the center of the base 350 in the longitudinal direction thereof. The resistive heat generators 362 and 363 are disposed on both lateral ends of the base 350 in the longitudinal direction thereof, respectively, and disposed upstream from the resistive heat generator 361 in the rotation direction R of the fixing belt 310.

The resistive heat generator 361 disposed on the center of the base 350 in the longitudinal direction thereof is connected to the electrode 360*c* and an electrode 360*dl* through the feeders 369*c* and 369*a*, respectively. The electrodes 360*c* and 360*dl* are disposed on both lateral ends of the base 350 in the longitudinal direction thereof and supply power to the resistive heat generator 361. Each of the feeders 369*a* and 369*c* includes the inboard end E2 and the outboard end E1 in the longitudinal direction of the base 350. Each of the feeders 369*a* and 369*c* is inclined such that the inboard end E2 is disposed downstream from the outboard end E1 in the rotation direction R of the fixing belt 310. The resistive heat generators 362 and 363 disposed on both lateral ends of the base 350 in the longitudinal direction thereof, respectively, are connected to the electrode 360*c* and an electrode 360*d*2 through feeders 369*f*, 369*g*, and 369*h*, respectively. The electrodes 360*c* and 360*d*2 are disposed on both lateral ends of the base 350 in the longitudinal direction thereof, respectively, and supply power to the resistive heat generators 362 and 363. The resistive heat generator 361 disposed on the center of the base 350 in the longitudinal direction thereof connected to the electrode 360*dl*. The resistive heat generators 362 and 363 disposed on both lateral ends of the base 350 in the longitudinal direction thereof, respectively, are connected to the electrode 360*d*2 that is separated from the electrode 360*dl*. Accordingly, the resistive heat generators 361, 362, and 363 allow the heater 91W to change a heating span between a broad heating span and a narrow heating span depending on the size of the sheet P.

Each of the feeders 369*f* and 369*h* includes the inboard end E2 and the outboard end E1 in the longitudinal direction of the base 350. Each of the feeders 369*f* and 369*h* is inclined such that the inboard end E2 is disposed downstream from the outboard end E1 in the rotation direction R of the fixing belt 310. The feeder 369*g* is interposed between the feeders 369*f* and 369*h* in the longitudinal direction of the base 350. A center of the feeder 369*g* in the longitudinal direction of the base 350 is bulged downstream in the rotation direction R of the fixing belt 310, thus defining an arc. The resistive heat generators 362 and 363 disposed on both lateral ends of the base 350 in the longitudinal direction thereof define the upstream projections 370*al*, respectively. The resistive heat generator 361 interposed between the resistive heat generators 362 and 363 substantially in the longitudinal direction of the base 350 defines the downstream projection 370*a*2. The upstream projections 370*al* and the downstream projection 370*a*2 are preferably symmetric with respect to the center position of the base 350 in the longitudinal direction thereof. Alternatively, the upstream projections 370*al* and the downstream projection 370*a*2 may not be symmetric.

Also in the heater 91W according to the sixth embodiment depicted in FIG. 8, the upstream projections 370*al* defined by the resistive heat generators 362 and 363 scrape and move the lubricant L applied to the inner circumferential surface of the fixing belt 310 at both lateral ends in the width direction thereof toward the center of the fixing belt 310 in the width direction thereof. The feeder 369*g* that is arcuate and the feeders 369*a* and 369*c*, each of which is inclined such that the inboard end E2 is disposed downstream from the outboard end E1 in the rotation direction R of the fixing belt 310, farther scrape and gather the lubricant L scraped and moved by the upstream projections 370*a*1 toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

A description is provided of a construction of a heater 91X according to a seventh embodiment of the present disclosure.

Figure 9:
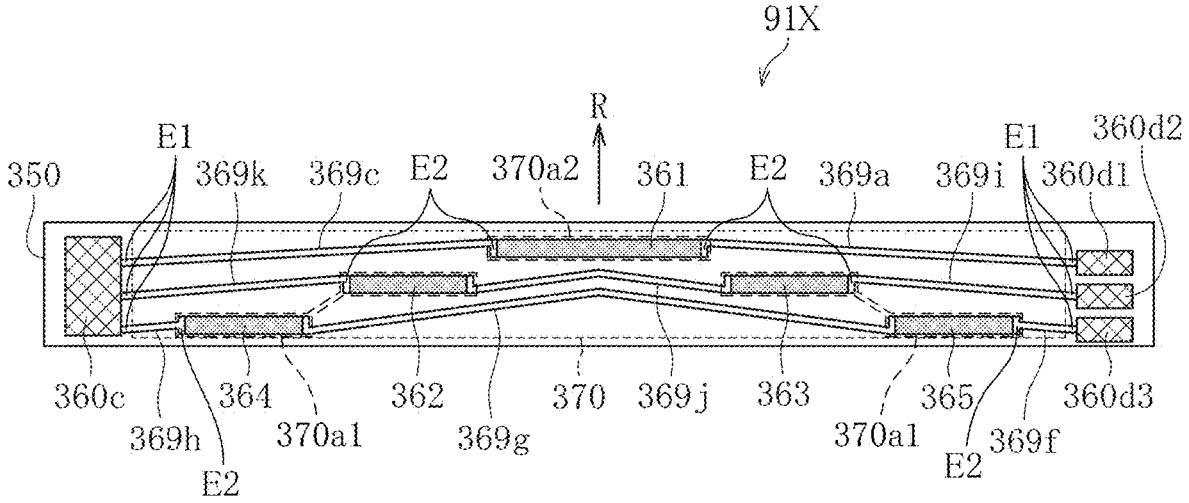
FIG. 9 is a plan view of a heater according to a seventh embodiment of the present disclosure, which is installable in the fixing device depicted in FIG. 2A.

FIG. 9 illustrates the heater 91X according to the seventh embodiment. The heater 91X includes five laminated, resistive heat generators 361 to 365, each of which has a strip shape. The resistive heat generator 361 is disposed on the center of the base 350 in the longitudinal direction thereof and is disposed downstream from the resistive heat generators 362 to 365 in the rotation direction R of the fixing belt 310. The resistive heat generators 364 and 365 are disposed on both lateral ends of the base 350 in the longitudinal direction thereof, respectively, and disposed upstream from the resistive heat generators 361 to 363 in the rotation direction R of the fixing belt 310. The resistive heat generator 362 is interposed between the resistive heat generator 361, that is, a most downstream, resistive heat generator, and the resistive heat generator 364, that is, a most upstream resistive heat generator, substantially in the longitudinal direction of the base 350 and substantially in the rotation direction R of the fixing belt 310. The resistive heat generator 363 is interposed between the resistive heat generator 361, that is, the most downstream, resistive heat generator, and the resistive heat generator 365, that is, a most upstream, resistive heat generator, substantially in the longitudinal direction of the base 350 and substantially in the rotation direction R of the fixing belt 310.

One lateral end of each of the resistive heat generators 361 to 365 in the longitudinal direction of the base 350 is coupled to the electrode 360*c* that is shared and supplies power to the resistive heat generators 361 to 365. Another lateral end of the resistive heat generator 361 in the longitudinal direction of the base 350 is coupled to the electrode 360*d*1. Another lateral end of each of the resistive heat generators 362 and 363 in the longitudinal direction of the base 350 is coupled to the electrodes 360*d*2. Another lateral end of each of the resistive heat generators 364 and 365 in the longitudinal direction of the base 350 is coupled to an electrodes 360*d*3. Thus, the resistive heat generators 361 to 365 are coupled to the three electrodes 360*dl*, 360*d*2, and 360*d*3 separately. Accordingly, the resistive heat generators 361 to 365 allow the heater 91X to change a heating span between three spans produced by combinations of the resistive heat generators 361 to 365 depending on the size of the sheet P.

The feeders 369*a* and 369*c* sandwich the resistive heat generator 361 disposed on the center of the base 350 in the longitudinal direction thereof. The feeders 369*a* and 369*c* are coupled to the resistive heat generator 361. Each of the feeders 369*a* and 369*c* includes the inboard end E2 and the outboard end E1 in the longitudinal direction of the base 350. Each of the feeders 369*a* and 369*c* is inclined such that the inboard end E2 is disposed downstream from the outboard end E1 in the rotation direction R of the fixing belt 310. Feeders 369*f*, 369*h*, 369*i*, and 369*k* are coupled to one lateral end of the resistive heat generators 365, 364, 363, and 362, respectively, in the longitudinal direction of the base 350. Like the feeders 369*a* and 369*c*, each of the feeders 369*f*, 369*h*, 369*i*, and 369*k* includes the inboard end E2 and the outboard end E1 in the longitudinal direction of the base 350. Each of the feeders 369*f*, 369*h*, 369*i*, and 369*k* is inclined such that the inboard end E2 is disposed downstream from the outboard end E1 in the rotation direction R of the fixing belt 310.

The feeder 369*g* couples the resistive heat generator 364 with the resistive heat generator 365. A feeder 369*j* couples the resistive heat generator 362 with the resistive heat generator 363. A center of each of the feeders 369*g* and 369*j* in the longitudinal direction of the base 350 projects downstream in the rotation direction R of the fixing belt 310, thus defining a V-shape. Accordingly, the resistive heat generators 362 to 365 disposed on both lateral ends of the base 350 in the longitudinal direction thereof define the upstream projections 370*al*, respectively. The resistive heat generator 361 disposed on the center of the base 350 in the longitudinal direction thereof defines the downstream projection 370*a*2. The upstream projections 370*al* and the downstream projection 370*a*2 are preferably symmetric with respect to the center position of the base 350 in the longitudinal direction thereof. Alternatively, the upstream projections 370*al* and the downstream projection 370*a*2 may not be symmetric.

Also in the heater 91X according to the seventh embodiment depicted in FIG. 9, the upstream projections 370*al* defined by the resistive heat generators 362 to 365 scrape and move the lubricant L adhered to the inner circumferential surface of the fixing belt 310 at both lateral ends in the width direction thereof toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

A description is provided of a construction of a heater 91Y according to an eighth embodiment of the present disclosure.

Figure 10:
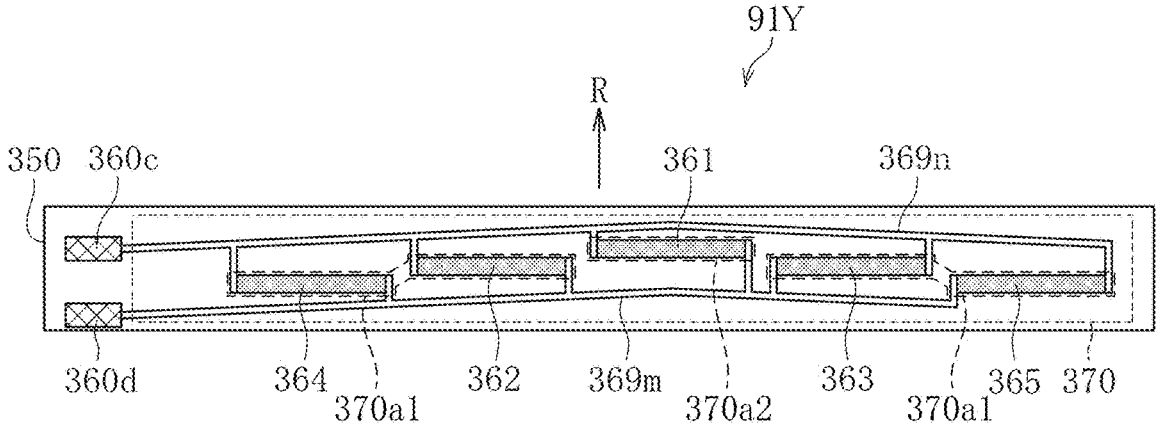
FIG. 10 is a plan view of a heater according to an eighth embodiment of the present disclosure, which is installable in the fixing device depicted in FIG. 2A.

FIG. 10 illustrates the heater 91Y according to the eighth embodiment. The heater 91Y includes the five laminated, resistive heat generators 361 to 365, each of which has a strip shape. The resistive heat generators 361 to 365 are connected in parallel. For example, one feeder, that is, a feeder 369*n*, is coupled to one electrode, that is, the electrode 360*c*, that supplies power to the resistive heat generators 361 to 365. The feeder 369*n* is coupled to one lateral end of each of the resistive heat generators 361 to 365. Another feeder, that is, a feeder 369*m*, is coupled to another electrode, that is, the electrode 360*d*, that supplies power to the resistive heat generators 361 to 365. The feeder 369*m* is coupled to another lateral end of each of the resistive heat generators 361 to 365.

The resistive heat generator 361 is disposed on the center of the base 350 in the longitudinal direction thereof and is disposed downstream from the resistive heat generators 362 to 365 in the rotation direction R of the fixing belt 310. The resistive heat generators 364 and 365 are disposed on both lateral ends of the base 350 in the longitudinal direction thereof, respectively, and disposed upstream from the resistive heat generators 361 to 363 in the rotation direction R of the fixing belt 310. The resistive heat generator 362 is interposed between the resistive heat generator 361, that is, a most downstream, resistive heat generator, and the resistive heat generator 364, that is, a most upstream, resistive heat generator, substantially in the longitudinal direction of the base 350 and substantially in the rotation direction R of the fixing belt 310. The resistive heat generator 363 is interposed between the resistive heat generator 361, that is, the most downstream, resistive heat generator, and the resistive heat generator 365, that is, a most upstream, resistive heat generator, substantially in the longitudinal direction of the base 350 and substantially in the rotation direction R of the fixing belt 310. The feeder 369*m* is disposed upstream from the feeder 369*n* in the rotation direction R of the fixing belt 310. A center of each of the feeders 369*m* and 369*n* in the longitudinal direction of the base 350 is bent downstream in the rotation direction R of the fixing belt 310, thus defining a V-shape.

Accordingly, the resistive heat generators 362 to 365 disposed on both lateral ends of the base 350 in the longitudinal direction thereof define the upstream projections 370*a*1, respectively. The resistive heat generator 361 disposed on the center of the base 350 in the longitudinal direction thereof defines the downstream projection 370*a*2. The upstream projections 370*al* and the downstream projection 370*a*2 are preferably symmetric with respect to the center position of the base 350 in the longitudinal direction thereof. Alternatively, the upstream projections 370*a*1 and the downstream projection 370*a*2 may not be symmetric.

Also in the heater 91Y according to the eighth embodiment depicted in FIG. 10, the upstream projections 370*a*1 defined by the resistive heat generators 362 to 365 scrape and move the lubricant L applied to the inner circumferential surface of the fixing belt 310 at both lateral ends in the width direction thereof toward the center of the fixing belt 310 in the width direction thereof. Accordingly, the lubricant L does not leak from both lateral ends of the fixing belt 310 in the width direction thereof. Consequently, the fixing device 300 does not suffer from shortage of the lubricant L over time, preventing the driving torque between the fixing belt 310 and the pressure roller 320 from increasing.

Figure 11A:
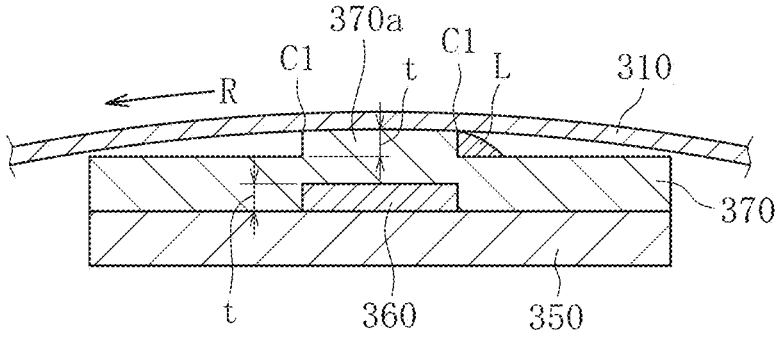
FIG. 11A is a cross-sectional view of the heater depicted in FIG. 3A, illustrating a projecting portion incorporated therein.
Figure 11B:
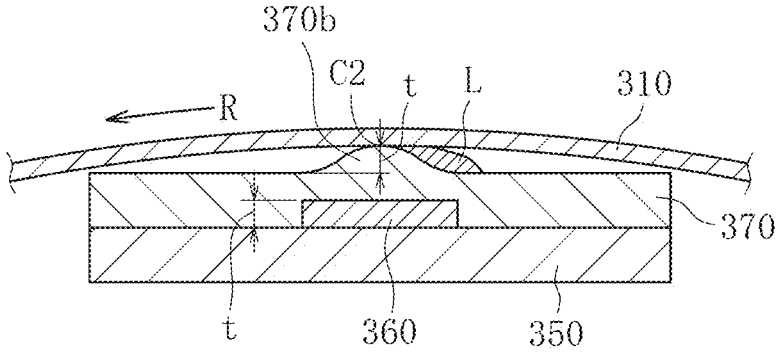
FIG. 11B is a cross-sectional view of the heater depicted in FIG. 3A, illustrating a projecting portion as one variation of the projecting portion depicted in FIG. 11A.

As illustrated in FIG. 1A, the projecting portion 370*a* (e.g., the upstream projections 370*a*1 and the downstream projection 370*a*2) described above may include shoulders C1 that are angular at a right angle and disposed at both ends of the projecting portion 370*a* in the rotation direction R of the fixing belt 310. In this case, the projecting portion 370*a* may cause the inner circumferential surface of the fixing belt 310 to be subject to abrasion and damage. To address this circumstance, as illustrated in FIG. 11B, a projecting portion 370*b* may be employed. The projecting portion 370*b* includes an arch C2 spanning an entirety of the projecting portion 370*b*, eliminating the shoulders C1 that are angular.

Accordingly, the fixing belt 310 contacts the projecting portion 370*b* softly, rendering the fixing belt 310 to be less subject to abrasion and damage. However, since a summit of the arch C2 has a decreased contact area, the summit of the arch C2 may tend to contact the inner circumferential surface of the fixing belt 310 with increased surface pressure. The increased surface pressure is not preferable in view of suppressing abrasion of the fixing belt 310.

Figure 11C:
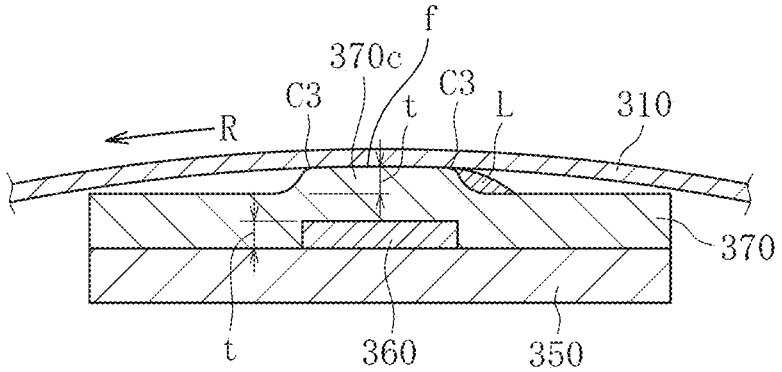
FIG. 11C is a cross-sectional view of the heater depicted in FIG. 3A, illustrating a projecting portion as another variation of the projecting portion depicted in FIG. 11A.

To address this circumstance, as illustrated in FIG. 11C, a projecting portion 370*c* may be employed. The projecting portion 370*c* includes a plane f on a top face of the projecting portion 370*c*. The plane f has a predetermined area. The plane f abuts on shoulders at both ends of the plane f in the rotation direction R of the fixing belt 310, respectively. Each of the shoulders defines an arch C3 that has a decreased radius of curvature. Accordingly, the plane f that contacts the fixing belt 310 increases a contact area where the projecting portion 370*c* contacts the fixing belt 310, reducing the surface pressure with which the projecting portion 370*c* contacts the fixing belt 310. Consequently, the projecting portion 370*c* suppresses abrasion of the fixing belt 310 and extends the life of the fixing belt 310.

The above describes the embodiments of the present disclosure. However, the technology of the present disclosure is not limited to the embodiments described above and is modified within the scope of the present disclosure.

A description is provided of advantages of a heater (e.g., the heaters 91, 91S, 91T, 91U, 91V, 91W, 91X, and 91Y).

As illustrated in FIGS. 2A, 3A, and 3B, a fixing rotator (e.g., the fixing belt 310), that is, an endless belt, is rotatable in a rotation direction (e.g., the rotation direction R) and slidable over the heater. The heater includes a base (e.g., the base 350), a resistive heat generator (e.g., the resistive heat generator 360), an electrode (e.g., the electrodes 360*c* and 360*d*), a conductor (e.g., the feeders 369*a* and 369*c*), and a slide layer (e.g., the insulating layer 370).

The base is a substrate or a board that is elongate and platy. The base is made of a heat resistant, insulating material. The resistive heat generator is mounted on a face of the base. The electrode supplies power to the resistive heat generator. The conductor couples the electrode with the resistive heat generator. The slide layer covers the resistive heat generator and the conductor. The slide layer includes a projecting portion (e.g., the projecting portion 370*a*) that defines a surface of the slide layer. The projecting portion is defined by a film thickness of at least one of the resistive heat generator and the conductor. The projecting portion includes an upstream projection (e.g., the upstream projections 370*al*) and a downstream projection (e.g., the downstream projection 370*a*2) disposed downstream from the upstream projection in the rotation direction of the endless belt. The upstream projection is disposed opposite a lateral end of the base in a longitudinal direction thereof. The downstream projection is disposed at a position different from a position of the upstream projection.

An upstream end (e.g., the outboard end E1) of the upstream projection defined by the at least one of the resistive heat generator and the conductor is disposed upstream from an upstream end (e.g., an upstream end E3) of the downstream projection defined by the at least one of the resistive heat generator and the conductor in the rotation direction of the endless belt.

Accordingly, the projecting portion scrapes and moves a lubricant (e.g., the lubricant L) adhered to a slide face of the endless belt toward a center of the endless belt in an axial direction thereof, suppressing leakage of the lubricant from both lateral ends of the endless belt in the axial direction thereof.

According to the embodiments described above, the fixing belt 310 serves as an endless belt. Alternatively, a fixing film, a fixing sleeve, or the like may be used as an endless belt. Further, the pressure roller 320 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heater over which an endless belt rotatable in a rotation direction is slidable, the heater comprising:

a base that is elongate and platy;

at least one resistive heat generator mounted on a face of the base;

at least one electrode configured to supply power to the at least one resistive heat generator;

a conductor configured to couple the at least one electrode with the at least one resistive heat generator; and a slide layer configured to cover the at least one resistive heat generator and the conductor, the slide layer including a projecting portion configured to define a surface of the slide layer, the projecting portion defined by a film thickness of at least one of the conductor and the at least one resistive heat generator, the projecting portion including:

an upstream projection disposed opposite a lateral end of the base in a longitudinal direction of the base; and a downstream projection disposed downstream from the upstream projection in the rotation direction of the endless belt.

2. The heater according to claim 1, wherein the downstream projection includes an upstream end in the rotation direction of the endless belt, and wherein the upstream projection includes an upstream end disposed upstream from the upstream end of the downstream projection in the rotation direction of the endless belt.

3. The heater according to claim 1, wherein the base is made of a heat resistant, insulating material.

4. The heater according to claim 1, wherein the projecting portion further includes an intermediate projection configured to couple the upstream projection with the downstream projection, and wherein the projecting portion is bulged downstream in the rotation direction of the endless belt into an arc.

5. The heater according to claim 1, wherein the at least one resistive heat generator includes:

a first laminated resistive heat generator having a first film thickness that defines the downstream projection;

a second laminated resistive heat generator having a second film thickness that defines the upstream projection; and a third laminated resistive heat generator having a third film thickness that defines the upstream projection.

6. The heater according to claim 5, wherein the at least one electrode includes:

a first electrode disposed on a first lateral end of the base in the longitudinal direction of the base; and a second electrode disposed on a second lateral end of the base in the longitudinal direction of the base.

7. The heater according to claim 6, wherein the first laminated resistive heat generator is interposed between the first electrode and the second electrode and disposed on a center of the base in the longitudinal direction of the base, wherein the second laminated resistive heat generator is interposed between the first laminated resistive heat generator and the first electrode and the third laminated resistive heat generator is interposed between the first laminated resistive heat generator and the second electrode, and wherein the first laminated resistive heat generator, the second laminated resistive heat generator, and the third laminated resistive heat generator are connected in series to the first electrode and the second electrode through the conductor.

8. The heater according to claim 6, wherein the first laminated resistive heat generator is disposed on a center of the base in the longitudinal direction of the base, wherein the second laminated resistive heat generator and the third laminated resistive heat generator are disposed on the first lateral end and the second lateral end of the base in the longitudinal direction of the base, respectively, and wherein the first laminated resistive heat generator, the second laminated resistive heat generator, and the third laminated resistive heat generator are connected in parallel to the first electrode and the second electrode through the conductor.

9. The heater according to claim 5, wherein the at least one electrode includes:

a first electrode disposed on one lateral end of the base in the longitudinal direction of the base; and a second electrode disposed on the one lateral end of the base in the longitudinal direction of the base.

10. The heater according to claim 9, wherein the first laminated resistive heat generator is disposed on a center of the base in the longitudinal direction of the base, wherein the second laminated resistive heat generator and the third laminated resistive heat generator are disposed on a first lateral end and a second lateral end of the base in the longitudinal direction of the base, respectively, and wherein the first laminated resistive heat generator, the second laminated resistive heat generator, and the third laminated resistive heat generator are connected in parallel to the first electrode and the second electrode through the conductor.

11. The heater according to claim 1, wherein the at least one resistive heat generator includes:

an outboard end; and an inboard end disposed inboard from the outboard end in the longitudinal direction of the base, and wherein the at least one resistive heat generator is inclined such that the inboard end is disposed downstream from the outboard end in the rotation direction of the endless belt.

12. The heater according to claim 1, wherein the conductor includes:

an outboard end; and an inboard end disposed inboard from the outboard end in the longitudinal direction of the base, and wherein the conductor is inclined such that the inboard end is disposed downstream from the outboard end in the rotation direction of the endless belt.

13. The heater according to claim 1, wherein the projecting portion further includes:

a plane configured to contact the endless belt; and a plurality of arches configured to abut on the plane at both ends of the plane in the rotation direction of the endless belt, respectively.

14. A fixing device comprising:

a fixing rotator that is endless, the fixing rotator configured to rotate in a rotation direction;

a heater over which an inner circumferential surface of the fixing rotator slides; and a pressure rotator disposed opposite the heater via the fixing rotator, the pressure rotator configured to form a fixing nip between the pressure rotator and the fixing rotator, the fixing nip through which a recording medium bearing an image formed with a developer is conveyed, the heater including:

a base that is elongate and platy;

at least one resistive heat generator mounted on a face of the base;

at least one electrode configured to supply power to the at least one resistive heat generator;

a conductor configured to couple the at least one electrode with the at least one resistive heat generator; and a slide layer configured to cover the at least one resistive heat generator and the conductor, the slide layer including a projecting portion configured to define a surface of the slide layer, the projecting portion defined by a film thickness of at least one of the conductor and the at least one resistive heat generator, the projecting portion including:

an upstream projection disposed opposite a lateral end of the base in a longitudinal direction of the base; and a downstream projection disposed downstream from the upstream projection in the rotation direction of the fixing rotator.

15. An image forming apparatus comprising:

a developing device configured to form an image with a developer; and a fixing device configured to fix the image on a recording medium, the fixing device including:

a fixing rotator that is endless, the fixing rotator configured to rotate in a rotation direction;

a heater over which an inner circumferential surface of the fixing rotator slides; and a pressure rotator disposed opposite the heater via the fixing rotator, the pressure rotator configured to form a fixing nip between the pressure rotator and the fixing rotator, the fixing nip through which the recording medium bearing the image formed with the developer is conveyed, the heater including:

a base that is elongate and platy;

at least one resistive heat generator mounted on a face of the base;

at least one electrode configured to supply power to the at least one resistive heat generator;

a conductor configured to couple the at least one electrode with the at least one resistive heat generator; and a slide layer configured to cover the at least one resistive heat generator and the conductor, the slide layer including a projecting portion configured to define a surface of the slide layer, the projecting portion defined by a film thickness of at least one of the conductor and the at least one resistive heat generator, the projecting portion including:

an upstream projection disposed opposite a lateral end of the base in a longitudinal direction of the base; and a downstream projection disposed downstream from the upstream projection in the rotation direction of the fixing rotator.

* * * * *